US009315355B2

(12) United States Patent
Aoji et al.

(10) Patent No.: US 9,315,355 B2
(45) Date of Patent: Apr. 19, 2016

(54) PAPER SHEET PROCESSING DEVICE

(75) Inventors: Hirokazu Aoji, Tokyo (JP); Sho Mizuno, Tokyo (JP); Yasuhiro Nakata, Tokyo (JP); Hiroshi Mizutani, Tokyo (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 14/234,520

(22) PCT Filed: Jul. 26, 2011

(86) PCT No.: PCT/JP2011/004199

§ 371 (c)(1),
(2), (4) Date: Apr. 7, 2014

(87) PCT Pub. No.: WO2013/014704

PCT Pub. Date: Jan. 31, 2013

(65) Prior Publication Data

US 2014/0217669 A1 Aug. 7, 2014

(51) Int. Cl.
*B65H 31/24* (2006.01)
*B65H 31/22* (2006.01)
(Continued)

(52) U.S. Cl.
CPC ..... *B65H 31/24* (2013.01); *B65H 1/266* (2013.01); *B65H 31/10* (2013.01); *B65H 31/22* (2013.01);
(Continued)

(58) Field of Classification Search
CPC ..... B65H 31/22; B65H 2402/32; B65H 1/28; B65H 1/266; B65H 31/24; B65H 83/025; B65H 2405/3311; B65H 2405/351; B65H 2405/3521; B65H 2405/361; B65H 2405/324; B65H 2405/121; B65H 2402/64; G07D 11/0081; G07D 11/0009
See application file for complete search history.

(56) References Cited

U.S. PATENT DOCUMENTS 3,087,771 A 4/1963 Pari
5,364,088 A * 11/1994 Maruyama et al. ..... 271/164
(Continued)

FOREIGN PATENT DOCUMENTS

CH 269462 7/1950
EP 1 056 369 B1 4/2002
(Continued)

OTHER PUBLICATIONS

PCT International Search Report on application PCT/JP2011/004199 mailed Oct. 4, 2011; 2 pages.
(Continued)

*Primary Examiner* — Jeremy R Severson
(74) *Attorney, Agent, or Firm* — Foley & Lardner LLP

(57) ABSTRACT

Device with: banknote processing unit (10); banknote storage unit (30) having a plurality of banknote storage parts (32) for separating and storing paper sheets; transport mechanism for bidirectionally transporting the paper sheets via a connection mechanism (45) connected between the banknote processing unit (10) and banknote storage unit (30); and a unit guide mechanism (50) that guides the banknote storage unit (30) in order to be stored in a drawer from a housing (102) and a storage space. The unit guide mechanism (50) has: first sliding mechanism (52) which is positioned on the housing (102) and storage body (31), and guides the storage body (31) from the storage space in a horizontal direction to store the storage body (31) in the drawer and the storage space; guide parts which are inside the housing (102), positioned along the connection mechanism (45) in the horizontal direction; and linked guide mechanisms (53) positioned on top of the banknote storage parts (32), and have guided parts that are guided by the guide parts.

11 Claims, 19 Drawing Sheets

(51) Int. Cl.

| | |
|---|---|
| ***G07D 11/00*** | (2006.01) |
| ***G07F 19/00*** | (2006.01) |
| ***B65H 1/26*** | (2006.01) |
| ***B65H 31/10*** | (2006.01) |

(52) U.S. Cl.
CPC ..... *G07D 11/0006* (2013.01); *G07D 11/0081* (2013.01); *G07F 19/20* (2013.01); *B65H 2402/32* (2013.01); *B65H 2402/64* (2013.01); *B65H 2404/611* (2013.01); *B65H 2405/324* (2013.01); *B65H 2405/3311* (2013.01); *B65H 2405/361* (2013.01)

(56) References Cited

U.S. PATENT DOCUMENTS

| | | | | |
|---|---|---|---|---|
| 5,593,152 | A * | 1/1997 | Wirth et al. | 271/241 |
| 8,905,220 | B2 * | 12/2014 | Yokote | 194/350 |
| 2008/0042338 | A1 * | 2/2008 | Desfosses et al. | 271/9.13 |
| 2009/0166956 | A1 * | 7/2009 | Kajiyama | 271/164 |
| 2013/0228967 | A1 * | 9/2013 | Maeda et al. | 271/264 |
| 2013/0334949 | A1 * | 12/2013 | Yokoyama et al. | 312/334.12 |

FOREIGN PATENT DOCUMENTS

| | | | |
|---|---|---|---|
| EP | 2 187 360 | A1 | 5/2010 |
| JP | 09-044723 | | 2/1997 |
| JP | 2010-250572 | A | 11/2010 |
| JP | 2011-053802 | | 3/2011 |

OTHER PUBLICATIONS

European Patent Office extended search report on application 11874644.5 mailed Apr. 29, 2015; 8 pages.

* cited by examiner

PAPER SHEET PROCESSING DEVICE

TECHNICAL FIELD

The present invention relates to a paper sheet processing device that processes paper sheets such as banknotes.

BACKGROUND ART

As this kind of paper sheet processing device, automatic cash transaction devices such as ATMs and CDs that are used to perform banknote deposit and withdrawal transactions are known, and such devices are installed in financial institutions and shops such as convenience stores. For example, as described in Patent Literature 1, a banknote processing device that is mounted in an automatic cash transaction device includes: a banknote receiving/dispensing port for releasing dispensed banknotes to a user or for delivering, one at a time, deposited banknotes that were inserted by a user; a banknote identifying part that identifies deposited or dispensed banknotes; a temporary storage part that temporarily stores deposited banknotes; a plurality of banknote storage parts for differentiating deposited banknotes and storing and safely keeping the banknotes, and delivering the banknotes as dispensed banknotes and the like; and a banknote transport path that connects each of the above described parts. The plurality of banknote storage parts described above are housed on trays that are slidable with respect to a housing to enable maintenance as well as replenishment of banknotes, and maintenance as well as replenishment of banknotes can be easily performed by pulling out the plurality of banknote storage parts from the housing together with the respective trays.

However, the banknote transport path is arranged above the plurality of banknote storage parts, and in order to attach and detach the banknote storage parts, connection points of the banknote transport path are separated from the banknote storage parts and retracted therefrom. Consequently, in a configuration in which a banknote transport path is retracted in this manner, there is the problem that the work prior to pulling out a tray is troublesome.

CITATION LIST

Patent Literature

PATENT LITERATURE 1: JP-A-9-44723

SUMMARY OF INVENTION

Technical Problem

In consideration of the above described problem, an object of the present invention is to provide a paper sheet processing device in which a configuration for drawing out a plurality of paper sheet storage parts that store paper sheets is simple, and in which such work is easy.

Solution to Problem

The present invention has been made to solve at least some of the above described problem, and can be realized as the following forms or application examples.

APPLICATION EXAMPLE 1

Application example 1 is a paper sheet processing device including: a paper sheet processing unit that discriminates paper sheets that are inserted or dispensed, a paper sheet storage unit having a plurality of paper sheet storage parts that separate and store the discriminated paper sheets, a transport mechanism that transports the paper sheets bidirectionally between the paper sheet processing unit and the paper sheet storage unit via a connection mechanism constituting a transport path that connects the paper sheet processing unit and the paper sheet storage unit, a housing having a storage space that stores the paper sheet processing unit, the paper sheet storage unit and the transport mechanism, and a unit guide mechanism that guides in order to draw out the paper sheet storage unit from the storage space and to store the paper sheet storage unit in the storage space; in which:

the paper sheet storage unit has a storage body that stores the plurality of paper sheet storage parts, and the storage body is configured so that the paper sheet storage parts assume a retracted position in which the paper sheet storage parts are placed on the storage body and so that the paper sheet storage parts can also be moved upward from the retracted position and stored;

the unit guide mechanism has:

a first sliding mechanism that is arranged on the housing and the storage body, and that guides in a horizontal direction in order to draw out the paper sheet storage unit from the storage space and also to store the paper sheet storage unit in the storage space, and linked guide mechanisms having a storing guide part that is arranged in the horizontal direction inside the housing, and a guided part that is arranged on the paper sheet storage part and is guided by the storing guide part, and in which the storing guide part can be configured so that, when guiding the guided part at a time of storing the paper sheet storage unit in the storage space, the storing guide part lifts up the paper sheet storage parts from the retracted position and sets the paper sheet storage parts on the transport path of the connection mechanism.

In the configuration of application example 1, when the paper sheet storage unit is drawn out via the first sliding mechanism of the unit guide mechanism with respect to the housing, the linked guide mechanisms move the paper sheet storage parts from a lifted-up state with respect to the storage body to the retracted position in which the paper sheet storage parts are placed on the storage body. At this time, because the paper sheet storage parts move in a direction away from the transport path of the connection mechanism, the respective paper sheet storage parts can be easily taken out from the storage body. Further, the linked guide mechanisms do not require a complicated configuration to cause the paper sheet storage parts retract from the transport path of the connection mechanism as in the description of the conventional technology, and thus the configuration is simple.

APPLICATION EXAMPLE 2

According to application example 2 a configuration can be adopted in which, relative to the paper sheet processing device described in application example 1, the storing guide part is storing guide rails that are arranged on both sides of the paper sheet storage parts that are stored in the storage space, and the guided part is first rollers that roll along the storing guide rails.

APPLICATION EXAMPLE 3

According to application example 3 a configuration can be adopted in which, relative to the paper sheet processing device described in application example 2, the storing guide rails include a general part that is arranged in the horizontal direction and an inclined guide part that inclines downward from an end part of the general part, and are configured so that, by the first rollers rolling along the inclined guide part, the paper sheet storage parts are guided between the retracted position and a position at which the paper sheet storage parts are set on the transport path.

APPLICATION EXAMPLE 4

According to application example 4 a configuration can be adopted in which, relative to the paper sheet processing device described in application example 3:

the storing guide rails include a positioning mechanism having a positioning part that positions the first rollers when the paper sheet storage parts are set on the transport path. According to this configuration, the positioning mechanism of the linked guide mechanisms can improve the connection reliability between the paper sheet storage parts and the connection mechanism by positioning the first rollers in the positioning parts, respectively.

APPLICATION EXAMPLE 5

According to application example 5 a configuration can be adopted in which, relative to the paper sheet processing device described in application example 4:

positions at which the first rollers separate from the plurality of positioning parts are respectively different in the horizontal direction. According to this configuration, the lengths in the horizontal direction of the positioning parts are different, and when drawing out the paper sheet storage unit, because the first rollers do not separate from the positioning parts at the same time, a load during an initial stage of the operation can be decreased.

APPLICATION EXAMPLE 6

According to application example 6 a configuration can be adopted in which, relative to the paper sheet processing device described in application example 3:

the linked guide mechanisms include a horizontal direction guide mechanism that guides the paper sheet storage parts in a direction that intersects with a storing direction. According to this configuration, the horizontal direction guide mechanism of the linked guide mechanisms can reliably guide the paper sheet storage parts to a predetermined position when the paper sheet storage parts are misaligned in the horizontal direction.

APPLICATION EXAMPLE 7

According to application example 7 a configuration can be adopted in which, relative to the paper sheet processing device described in application example 6:

the horizontal direction guide mechanism includes an adjusting guide rail that is arranged along the storing guide part, and second rollers that are mounted on the paper sheet storage parts, in which the second rollers are configured to receive a force from the adjusting guide rail and guide the paper sheet storage parts in the horizontal direction.

APPLICATION EXAMPLE 8

According to application example 8 a configuration can be adopted in which, relative to the paper sheet processing device described in any one of application examples 1 to 7:

the unit guide mechanism includes:

a second sliding mechanism that guides the paper sheet processing unit in order to draw out the paper sheet processing unit from the storage space or store the paper sheet processing unit in the storage space; and in the linked guide mechanisms, the storing guide part is mounted to the paper sheet processing unit.

APPLICATION EXAMPLE 9

According to application example 9 a configuration can be adopted in which, relative to the paper sheet processing device described in application example 8, the paper sheet processing device further includes:

a lock mechanism having a first lock mechanism that locks drawing out of the paper sheet processing unit and a second lock mechanism that locks drawing out of the paper sheet storage unit, in which:

the first lock mechanism includes a first engagement member to be locked that is provided in the housing, a first operation part, and a first lock member that moves in response to movement of the first operation part to assume a locking position at which the first lock member engages with the first engagement member to be locked or a non-locking position at which the first lock member does not engage therewith;

the second lock mechanism includes a second engagement member to be locked that is provided in the housing, a second operation part, and a second lock member that moves in response to movement of the second operation part to assume a locking position at which the second lock member engages with the second engagement member to be locked or a non-locking position at which the second lock member does not engage therewith;

in which the first and second lock mechanisms are linked so as to restrict shifting of the second lock member to the non-locking position when the paper sheet processing unit is in a drawn-out position, and to restrict shifting of the first lock member to the non-locking position when the paper sheet storage unit is in a drawn-out position. According to this configuration, simultaneous drawing out of the paper sheet processing unit and the paper sheet storage unit can be prevented.

APPLICATION EXAMPLE 10

According to application example 10 a configuration can be adopted in which, relative to the paper sheet processing device described in application example 9, the first and second engagement members to be locked are single members with which the first and second lock members engage, respectively.

DESCRIPTION OF EMBODIMENTS

(1) Schematic Configuration of Automatic Cash Transaction Device 101

Figure 1:
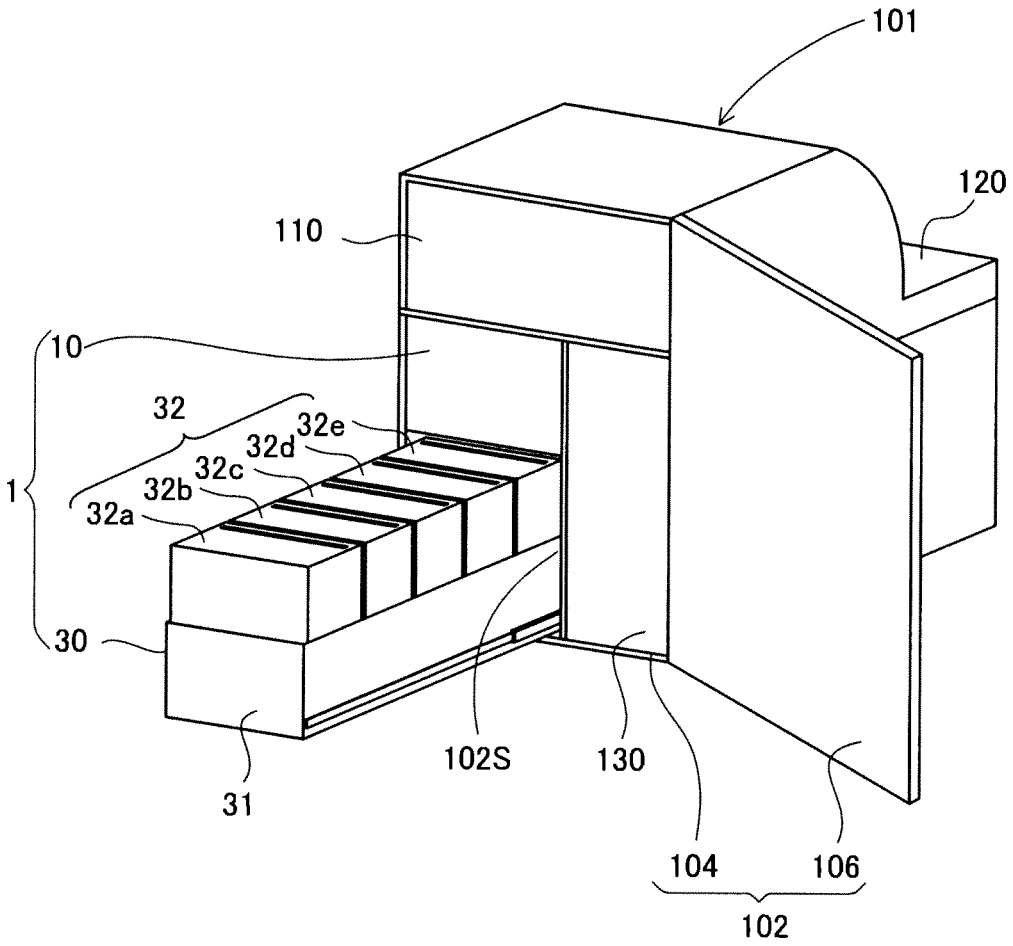
FIG. 1 is a perspective view that illustrates the outer appearance of an automatic cash transaction device in which a banknote processing device as a paper sheet processing device is mounted.

Hereunder, one embodiment of the present invention is described using the accompanying drawings. FIG. 1 is a perspective view that illustrates the external appearance of an automatic cash transaction device 101 in which a banknote handling device 1 as a paper sheet processing device is mounted. The automatic cash transaction device 101 is a device that is managed by a financial institution such as a bank and performs various transactions in accordance with an operation of a user (customer). For example, the automatic cash transaction device 101 adopts cards, banknotes and advice slips as media, and performs processing to accept a deposit from or make a payment to a user or to allow a user to transfer funds and the like. The automatic cash transaction device 101 is stored in a storage space 102S of the housing 102. A banknote handling device 1, an advice slip processing mechanism 110, a customer operation part 120 and a coin processing device 130 are stored in the housing 102, and are surrounded by a housing main body 104 and a door 106 for opening and closing a rear opening of the housing main body 104. The banknote handling device 1 is arranged at a lower part in the illustration of the automatic cash transaction device 101, and is a device that handles banknotes. The card and advice slip processing mechanism 110 is arranged at an upper part of the automatic cash transaction device 101, and is a device that processes a card of a user and prints and outputs a transaction advice slip. The customer operation part 120 is a device for displaying and inputting contents of a transaction at the front side of a front face of the device. The coin processing device 130 is arranged at the lower part of the automatic cash transaction device 101, and is a device that handles coins. Although not illustrated in the drawing, the automatic cash transaction device 101 also includes a power supply unit, an overall control unit for controlling the entire automatic cash transaction device 101, and a main body control part (not shown in the drawings) to which each mechanism is connected by a circuit such as a USB.

(2) Configuration of Banknote Handling Device 1

The banknote handling device 1 includes a banknote processing unit 10 (paper sheet processing unit) that is arranged at an upper portion thereof, a banknote storage unit 30 (paper sheet storage unit) that is arranged at a lower portion thereof, and a control unit (not shown in the drawings) that controls both units, and is stored in a manner in which the banknote processing unit 10 and banknote storage unit 30 can be taken out from the inside of the housing by opening the door 106 of the housing 102. Note that a mechanism for storing the banknote processing unit 10 and the banknote storage unit 30 is described later.

Figure 2:
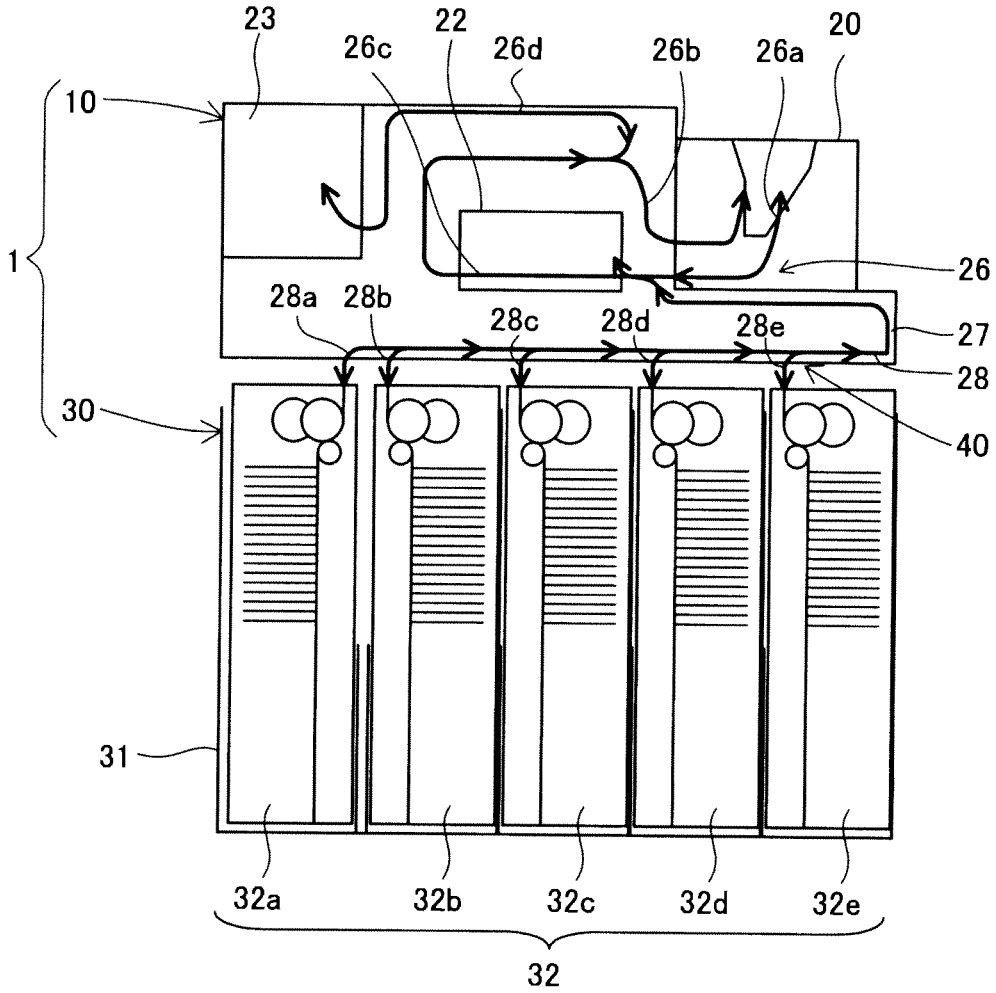
FIG. 2 is a cross-sectional side view illustrating a schematic configuration of the banknote handling device.

FIG. 2 is a cross-sectional side view that illustrates the schematic configuration of the banknote handling device 1.

(2)-1 Configuration of Banknote Processing Unit 10:

The banknote processing unit 10 mainly includes mechanisms that are required for accepting banknotes from and dispensing banknotes to users, and is equipped with a banknote receiving/dispensing port part 20, a banknote identifying part 22, a temporary storage part 23, an upper unit transport mechanism 26 that transports banknotes between respective parts, and a connecting transport mechanism 27 that transports banknotes from the upper unit transport mechanism 26 to the banknote storage unit 30.

The banknote receiving/dispensing port part 20 includes a deposit part which a user uses to deposit banknotes, and a withdrawal part that is used to dispense banknotes. The banknote identifying part 22 is a mechanism that determines the denominations and authenticity of banknotes and whether or not a banknote is a reject banknote, and outputs the determined results to the control unit. For example, the banknote identifying part 22 is configured to utilize various kinds of information such as image data obtained by scanning banknotes, convexo-concave shapes on the surface of banknotes, magnetic properties, and optical properties with respect to ultraviolet light. In this case, the term "reject banknotes" refers to banknotes that are determined to be unsuitable with respect to the authenticity of the banknotes or banknotes for which the authenticity is unknown because the banknotes are overlapping or folded. The temporary storage part 23 is a mechanism that temporarily holds banknotes during the course of transportation of the banknotes between the banknote deposit part or withdrawal part and the banknote storage unit 30.

The upper unit transport mechanism 26 is a mechanism that transports banknotes by rotational driving of rollers (not shown in the drawings), and includes a transport path for deposits 26*a* that transports banknotes that were inserted into the deposit part of the banknote receiving/dispensing port part 20, a transport path for withdrawals 26*b* that delivers banknotes to the withdrawal part, a transport path for identification 26*c* that causes banknotes to pass through the banknote identifying part 22, and a temporary storage part transport path 26*d* that transports banknotes to the temporary storage part 23. The transport path for identification 26*c* and the temporary storage transport path and the like are configured to be capable of transporting banknotes bidirectionally. Further, a gate and the like that are not illustrated in the drawings are arranged at a location where transport paths branch, and are configured so as to be capable of switch a transport direction of banknotes on the aforementioned transport paths. In addition, sensors for detecting passage of banknotes and the like are arranged on the transport paths, and detection signals of these sensors are sent to the control unit and used to determine passage of banknotes as well as the existence or non-existence of banknotes.

(2)-2 Configuration of Banknote Storage Unit 30:

In FIG. 1 and FIG. 2, the banknote storage unit 30 includes a storage body 31 and banknote storage parts 32 (paper sheet storage parts). The storage body 31 is a case whose upper part is open, and the banknote storage parts 32 are stored in the storage space thereof. The banknote storage parts 32 include five banknote storage parts 32*a* to 32*e*. The five banknote storage parts 32*a* to 32*e* have approximately the same configuration, and include a storage box that forms a banknote storage space for storing banknotes, and rollers and a sensor and the like that are arranged at an upper part of the storage parts. The respective banknote storage parts 32*a* to 32*e* store banknotes that were sent from the banknote processing unit 10 in the banknote storage space, and also have a mechanism that transports stored banknotes bidirectionally with respect to the banknote processing unit 10 by means of a transport mechanism such as rollers. The banknote storage parts 32*a* to 32*e* can be used to enable the handling of different kinds of banknotes, for example, the banknote storage parts 32*a* to 32*e* can be used as banknote containers for storing 10,000 yen, 5,000 yen, 1,000 yen and 2,000 yen banknotes and a reject container for storing the aforementioned reject banknotes.

(2)-3 Mechanism Linking Banknote Processing Unit 10 and Banknote Storage Unit 30

In FIG. 2, the connecting transport mechanism 27 includes a main transport path and sub-transport paths 28*a* to 28*e* that branch from the main transport path 28 to the respective banknote storage parts 32, and transports banknotes bidirectionally to the respective banknote storage parts 32*a* to 32*e*.

Figure 3:
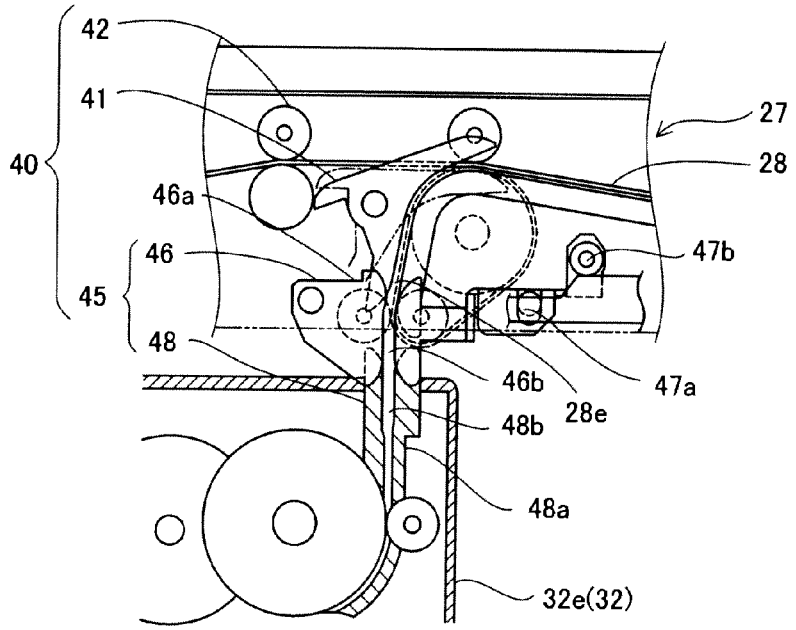
FIG. 3 is a cross-sectional view illustrating a connecting transport mechanism and a branch connection mechanism.
Figure 4:
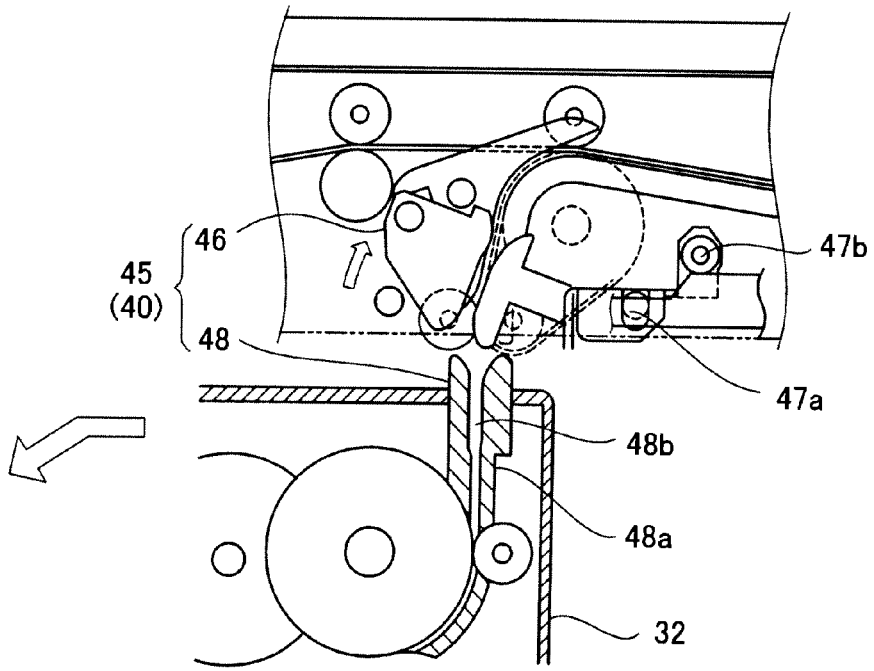
FIG. 4 is an explanatory drawing that illustrates operations in the configuration shown in FIG. 3.

FIG. 3 and FIG. 4 are cross-sectional views that illustrate the vicinity of a branching location of the connecting transport mechanism 27. In FIG. 3, respective branch connection mechanisms 40 are arranged at the branching locations of the connecting transport mechanism 27. Here, among the branch connection mechanisms 40, the branch connection mechanism 40 of the sub-transport path 28*e* that is connected to the banknote storage part 32*e* will be described. The branch connection mechanism 40 includes a gate 41, a roller group 42 including a plurality of rollers for guiding banknotes to the sub-transport path 28*e*, and a connection mechanism 45. The gate 41 is an L-shape member that is arranged at the branching location. The gate 41 is driven by a driving apparatus (a motor or the like) that is not shown in the drawings so that the gate 41 can be switched so that banknotes that are transported on the main transport path 28 follow the roller group 42 and are also transported bidirectionally with respect to the sub-transport path 28*e* or the like. In FIG. 3, the gate 41 (shown by a solid line) is at a position that switches to the sub-transport path 28*e*, and the gate 41 that is shown by a chain double-dashed line is at a position for transporting to another of the sub-transport paths 28*a* to 28*d*.

The connection mechanism 45 includes an upstream guide part 46 and a downstream guide part 48. The upstream guide part 46 includes a guide main body 46*a*. The guide main body 46*a* includes a guide groove 46*b* that is formed so as to follow the sub-transport path 28*a*. Banknotes are transported along the guide groove 46*b*. The downstream guide part includes a guide main body 48*a* that is arranged on the banknote storage parts 32 side. The guide main body 48*a* includes a guide groove 48*b* that is formed so as to follow the sub-transport path 28*e*. Banknotes are transported along the guide groove 48*b*. The upstream guide part 46 and the downstream guide part 48 are each formed in a comb-tooth shape, and connection points between the upstream guide part 46 and the downstream guide part 48, that is, the lower part of the upstream guide part 46 and the upper part of the downstream guide part 48, mesh with each other between the respective combs, and one part of the sub-transport path 28*e* is constituted by the guide grooves 46*b* and 48*b* that are formed in an unbroken wall surface.

The upstream guide part 46 is configured to be rotatable by means of a rotary shaft 47*a*, and the rotary shaft 47*a* can be rotated upon receiving a driving force of a motor drive shaft 47*b* of a motor that is not shown in the drawings. Accordingly, in the connection mechanism 45, in a case where power is not being supplied to the motor or when resetting is being performed, as shown in FIG. 4, by movement of the upstream guide part 46, a non-connecting mode (non-connecting position) is entered in which no portion of the upstream guide part 46 overlaps with the upper part of the downstream guide part 48, and when power is supplied to the motor, a connecting mode (connecting position) is entered as shown in FIG. 3.

(2)-4 Outline of Operations of Banknote Handling Device 1

In FIG. 2, when performing deposit processing, banknotes that were inserted into the deposit part of the banknote receiving/dispensing port part 20 are separated and fed one by one by the banknote receiving/dispensing port part 20 and transported via the transport path for deposits 26*a* and the transport path for withdrawals 26*b* to the banknote identifying part 22, and furthermore to the temporary storage part 23 via the temporary storage part transport path 26*d*. At this time, the banknotes are counted and identified by the banknote identifying part 22 when the banknotes pass therethrough. After the transaction amount is confirmed, the banknotes that are held by the temporary storage part 23 are separated and fed one by one and transported via the transport path for identification 26*c* to be counted and identified again at the banknote identifying part 22, and arrive at the connecting transport mechanism 27. From the connecting transport mechanism 27, the banknotes are respectively transported to one of the banknote storage parts 32 (32*a* to 32*e*) that was specified by the main body control part. Thus, the deposit transaction ends.

When performing withdrawal processing, banknotes are separated and fed one by one from a banknote storage part 32 that was specified by the main body control part. The banknotes pass through the connecting transport mechanism 27 and the transport path for identification 26*c* of the upper unit transport mechanism 26, and after being identified and counted by the banknote identifying part 22 arrive at the withdrawal part of the banknote receiving/dispensing port part 20 via the transport path for withdrawals 26*b* and are provided to the customer. Thus, the withdrawal transaction ends.

(3) Unit Guide Mechanism 50

Figure 5:
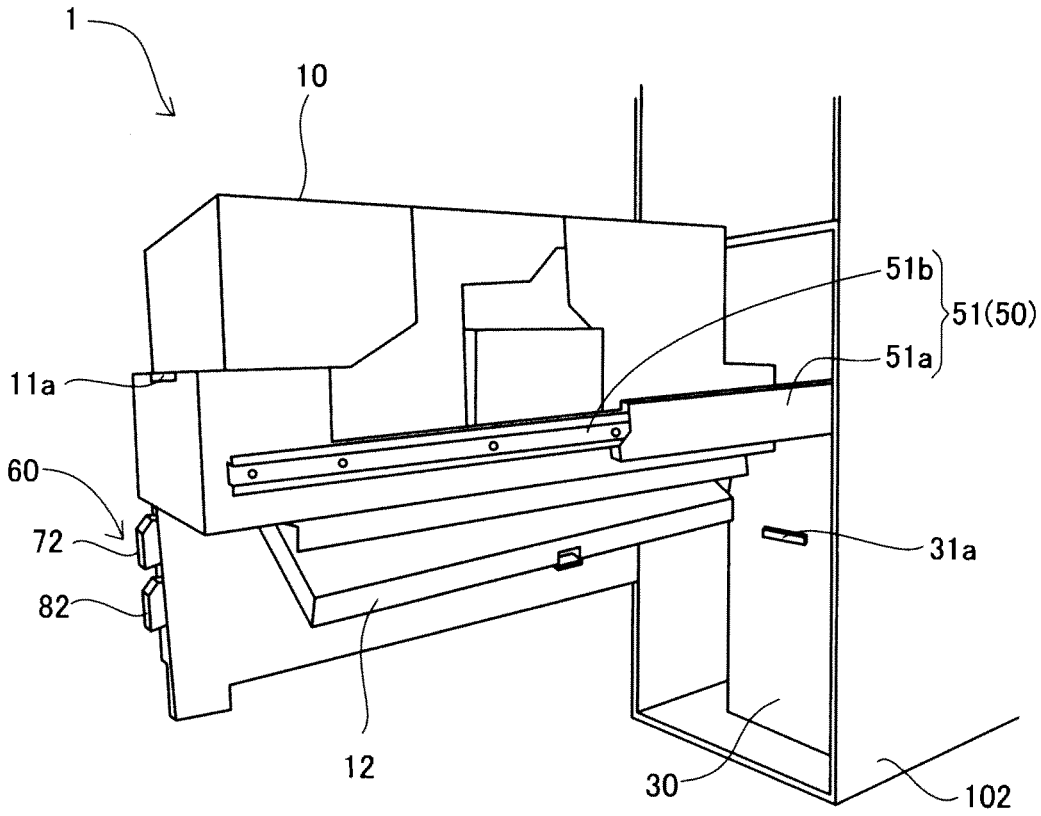
FIG. 5 is a perspective view illustrating a state in which a banknote processing unit is drawn out from a housing.
Figure 6:
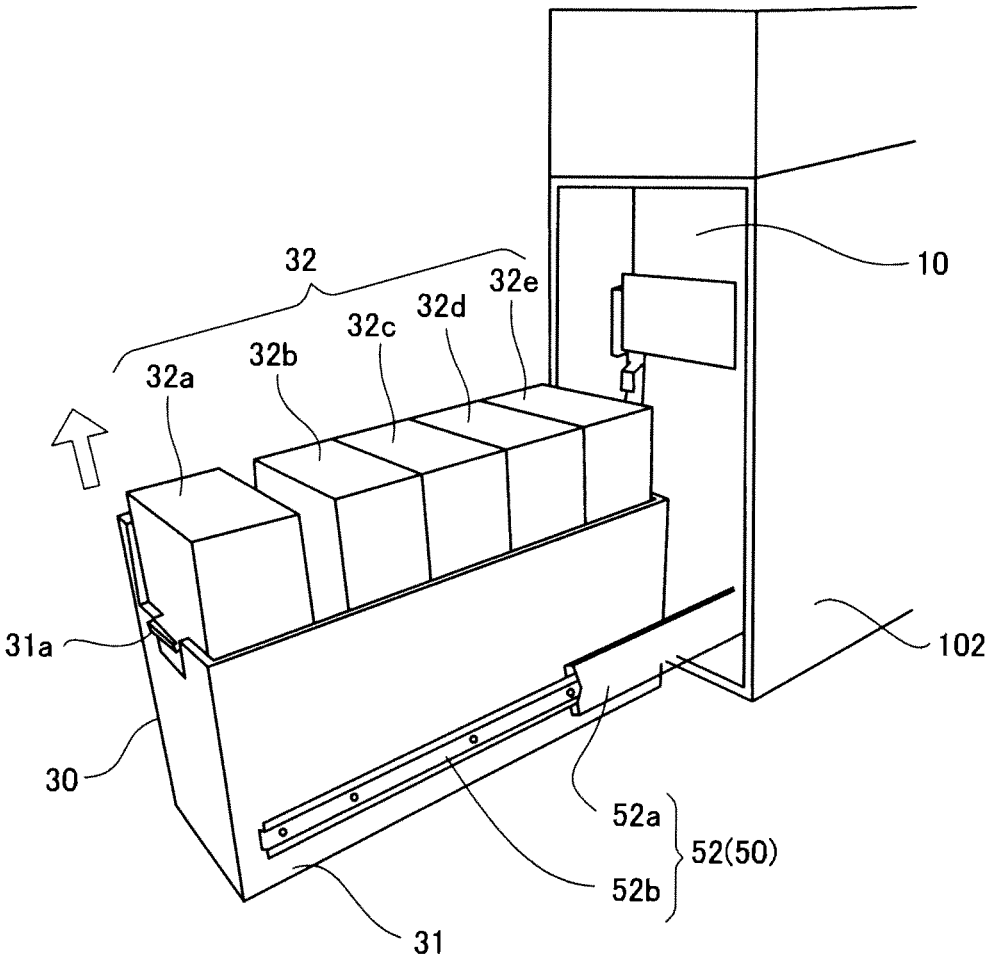
FIG. 6 is a perspective view illustrating a state in which a banknote storage unit is drawn out from the housing.

FIG. 5 is a perspective view showing a state in which the banknote processing unit 10 is drawn out from the housing 102. FIG. 6 is a perspective view showing a state in which the banknote storage unit 3010 is drawn out from housing 102. A unit guide mechanism 50 is a mechanism that draws out the banknote processing unit 10 and the banknote storage unit 30 from the housing 102, and includes a second sliding mechanism 51 that is shown in FIG. 5 and a first sliding mechanism 52 that is shown in FIG. 6. In FIG. 5, the second sliding mechanism 51 includes a guide part 51*a* that is fixed to an inner wall of the housing 102 and a guided part 51*b* that is fixed to a side wall of the banknote processing unit 10, and the guide part 51*a* fits together in a slidable manner with the guided part 51*b* to thereby guide an operation to draw out the banknote processing unit 10 in the horizontal direction from the housing 102 or to store the banknote processing unit 10 in the housing 102.

In FIG. 6, the first sliding mechanism 52 includes a guide part 52*a* that is fixed to an inner wall of the housing 102, and a guided part 52*b* that is fixed to a side wall of the banknote storage unit 30, and the guide part 52*a* fits together in a slidable manner with the guided part 52*b* to thereby guide an operation in which the user grasps a handle of the banknote storage unit 30 and draws out the banknote storage unit 30 in the horizontal direction from the housing 102 or stores the banknote storage unit 30 in the housing 102.

Accordingly, by opening the door 106 of the housing 102 as shown in FIG. 1, and as shown in FIG. 5, grasping a handle 11*a* of the banknote processing unit 10 and applying a force in the frontward direction, the banknote processing unit 10 can be drawn out. It is thereby possible, for example, to release jammed banknotes by opening a bottom cover that is shown in FIG. 5. Further, as shown in FIG. 6, work to collect banknotes or to replenish banknotes can be performed by grasping a handle 31*a* of the banknote storage unit 30 and drawing out the banknote storage unit 30 and then taking out the banknote storage parts 32 from the storage body 31.

(4) Linked Guide Mechanisms 53

Figure 7:
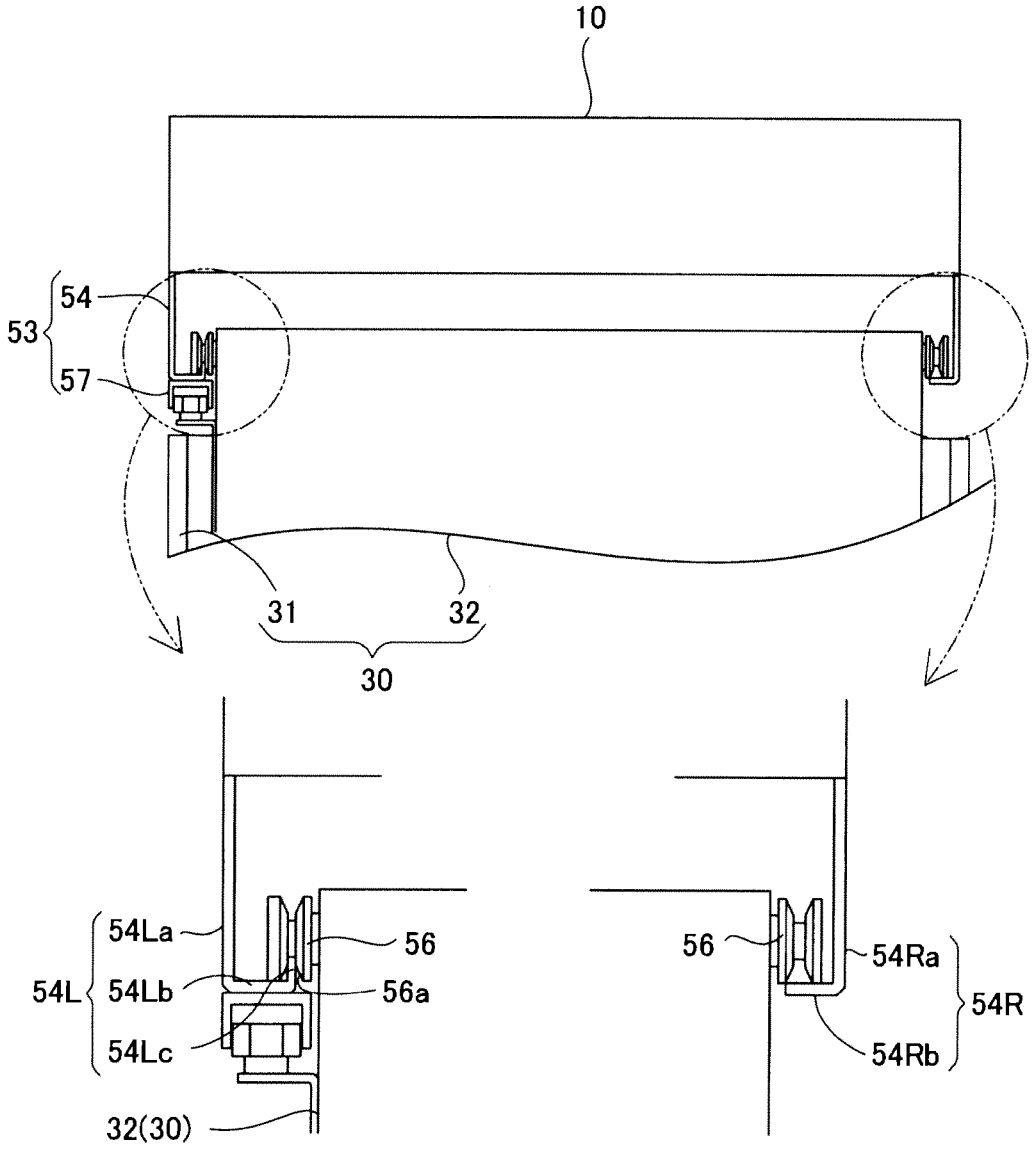
FIG. 7 is an explanatory drawing illustrating linked guide mechanisms.
Figure 8:
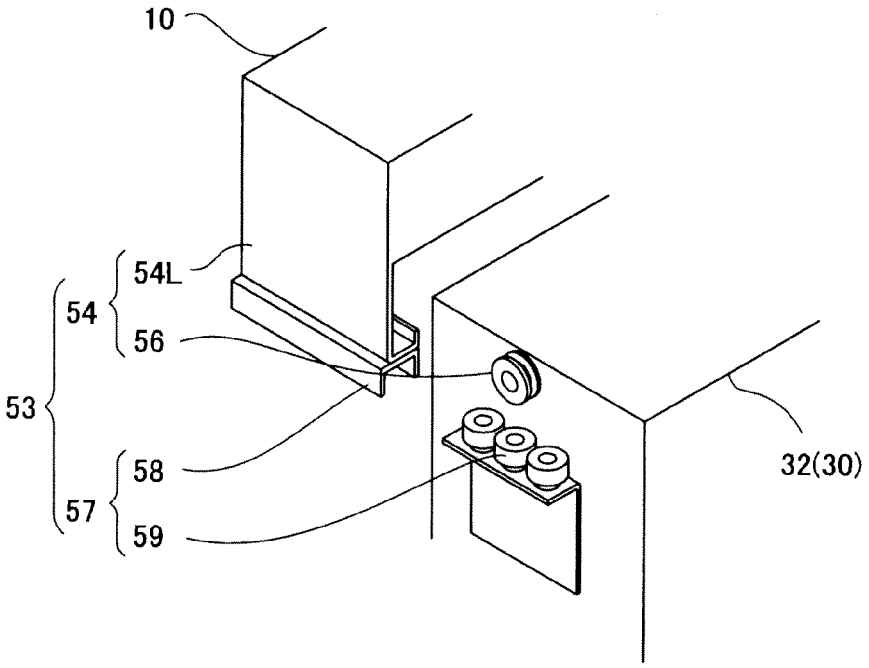
FIG. 8 is an explanatory drawing illustrating main parts of the linked guide mechanisms.

FIG. 7 is an explanatory drawing that illustrates linked guide mechanisms 53 that suspend and guide the banknote storage parts 32 of the banknote storage unit 30 in the banknote processing unit 10. FIG. 8 is an explanatory drawing that illustrates one of the linked guide mechanisms 53 in a state in which one of the banknote storage parts 32 of the banknote storage unit 30 is disengaged from the banknote processing unit 10. In FIG. 7, the linked guide mechanisms 53 are mechanism that suspend a plurality of the banknote storage parts 32 that are stored in the storage body 31 of the banknote storage unit 30 with respect to the banknote processing unit 10, and when the banknote processing unit 10 and the banknote storage unit 30 move relatively, guide movement in the vertical direction and horizontal direction of the banknote storage parts 32. The linked guide mechanisms 53 include a suspension mechanism 54 and a horizontal direction guide mechanism 57.

(4)-1 Suspension Mechanism 54

The suspension mechanism 54 includes storing guide rails 54R and 54L that are fixed to both side walls of the banknote processing unit 10, and first rollers 56 that are mounted to the side walls of the banknote storage parts 32 at the upper part thereof. The storing guide rails 54R and 54L are long members that are arranged across almost the entire length in the horizontal direction of the banknote processing unit 10 and from which the banknote storage parts 32 are suspended. The cross-sectional shapes of the storing guide rail 54R and the storing guide rail 54L are different to each other. The storing guide rail 54L includes a rail base 54La that is provided in a downward direction from the side wall of the banknote processing unit 10, a horizontal part 54Lb that is bent from a lower end of the rail base 54La, and a supporting erect part 54Lc that is bent upward from an end part of the horizontal part 54Lb. The first rollers 56 are rotatably supported at an upper part of the side wall on both sides of the banknote storage parts 32, respectively. The first rollers 56 are formed in a pulley shape that has an inclined groove 56*a* that inclines towards the center. The first roller 56 rolls on the storing guide rail 54L in a state in which the supporting erect part 54Lc of the storing guide rail 54L is inserted in the inclined groove 56*a*. On the other hand, the storing guide rail 54R includes a rail base 54Ra and a supporting horizontal part 54Rb. By mounting the first roller 56 on the supporting horizontal part 54Rb, the first roller 56 rolls on the storing guide rails 54R.

Figure 9:
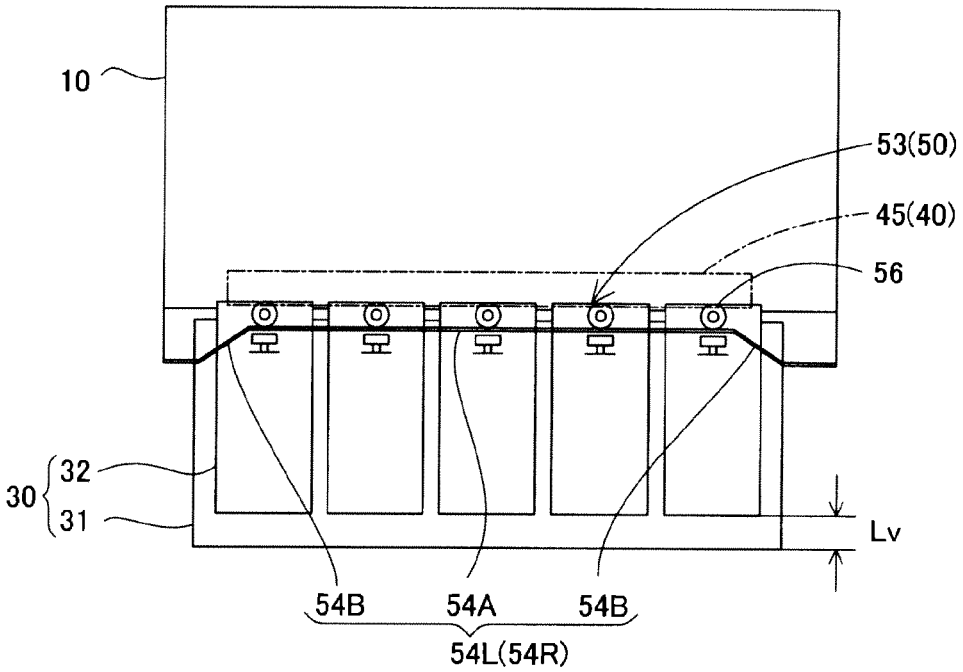
FIG. 9 is an explanatory drawing illustrating the configuration of the linked guide mechanisms.

FIG. 9 is an explanatory drawing illustrating a side of the suspension mechanism 54 on which the storing guide rail 54L is arranged when viewing the banknote processing unit 10 and the banknote storage unit 30 from the side. Since the storing guide rails 54R and 54L are substantially the same shape in the longitudinal direction, the storing guide rail 54L will be described as a representative of the storing guide rails 54R and 54L. The storing guide rail 54L includes a general part 54A and inclined guide parts 54B formed on both sides of the general part 54A. The general part 54A is a linear shape having the cross-sectional shape illustrated in FIG. 7 as described above. The inclined guide parts 54B incline downward from the general part 54A.

Figure 10:
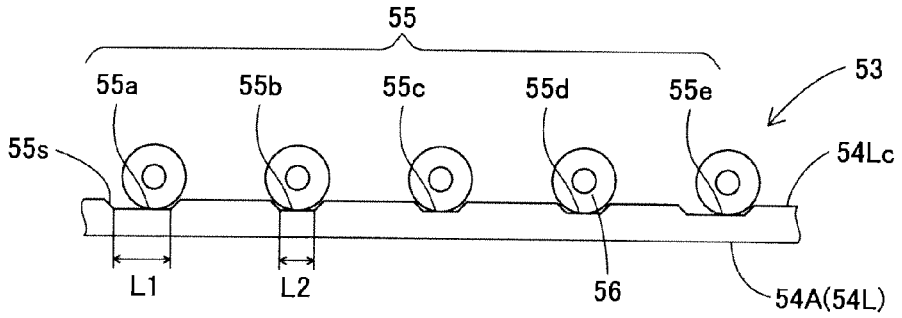
FIG. 10 is an explanatory drawing illustrating a positioning mechanism of the linked guide mechanisms.
Figure 11:
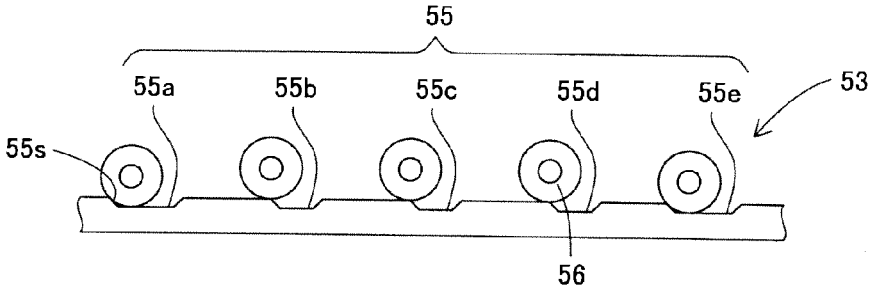
FIG. 11 is an explanatory drawing illustrating an action of the positioning mechanism of the linked guide mechanisms.

FIG. 10 and FIG. 11 are explanatory drawings that illustrate a positioning mechanism 55 of the general part 54A of the storing guide rail 54L. In FIG. 10, a positioning mechanism 55 that is constituted by a plurality of positioning parts 55*a* to 55*e* is formed at an upper part of the general part 54A. The positioning parts 55*a* to 55*e* are recesses for positioning the respective banknote storage parts 32, and by entry of the first rollers 56 therein, the positioning parts 55*a* to 55*e* position the respective banknote storage parts 32 with high accuracy with respect to the connection mechanism 45 (see FIG. 3) of the banknote processing unit 10. A length L1 of the positioning parts 55*a* and 55*e* in the horizontal direction is longer than a length L2 of the positioning parts 55*b*, 55*c* and 55*d*. Accordingly, as shown in FIG. 11, the positioning mechanism 55 is configured so that at a time when the first rollers 56 of the banknote storage unit 30 come out from the positioning mechanism 55, the first rollers 56 come out from the positioning parts 55*a* and 55*e* later than from the positioning parts 55*b*, 55*c* and 55*d*. Note that, as long as the positioning parts have a configuration that can position the first rollers 56, the respective positioning parts may be protrusions or the like and are not limited to recesses.

(4)-2 Horizontal Direction Guide Mechanism 57

Figure 12:
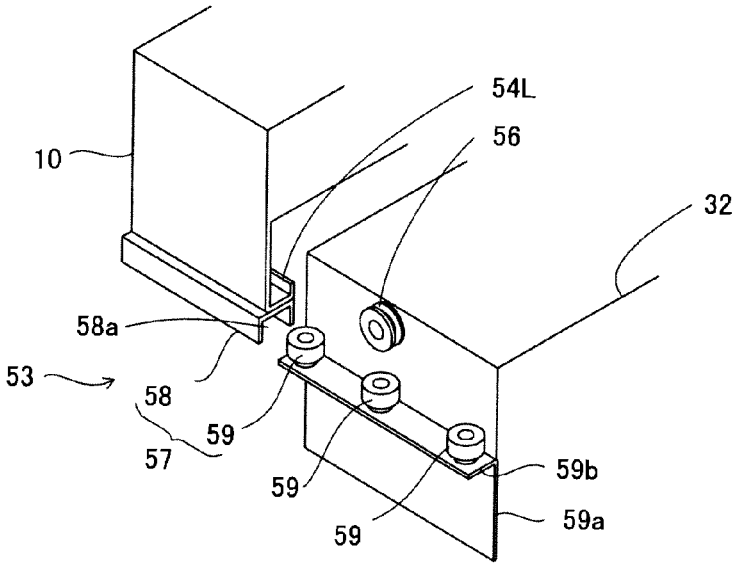
FIG. 12 is an explanatory drawing illustrating a horizontal direction guide mechanism of the linked guide mechanisms.
Figure 13:
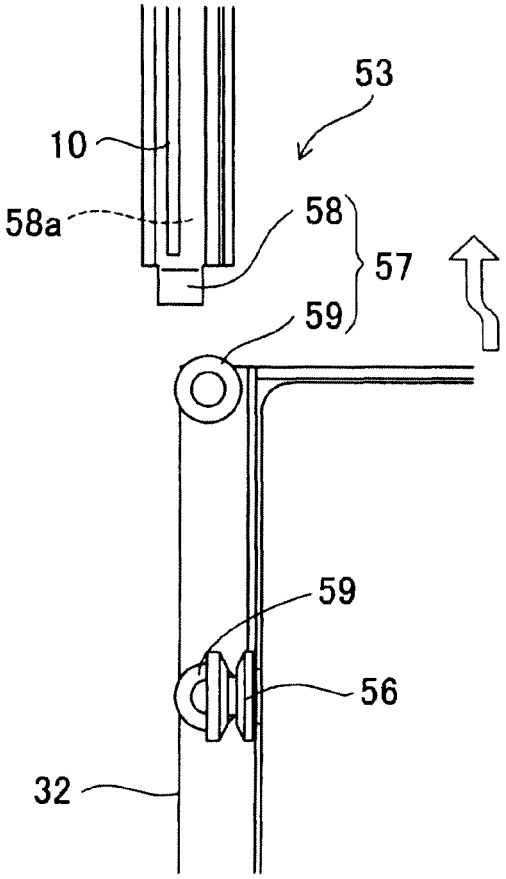
FIG. 13 is an explanatory drawing illustrating an action of the horizontal direction guide mechanism.

FIG. 12 is a perspective view illustrating the horizontal direction guide mechanism 57, and FIG. 13 is an explanatory drawing that illustrates the vicinity of the horizontal direction guide mechanism 57 as viewed from above. The horizontal direction guide mechanism 57 is a mechanism for guiding the banknote storage parts 32 in the lateral direction, and includes second rollers 59 that are mounted to one of the side walls of the banknote storage parts 32, and an adjusting guide rail 58 that is fixed to a lower face of the storing guide rail 54L. The second rollers 59 include a fitting tool 59*a* that is mounted in an L-shape to the side wall of each of the banknote storage parts 32. The second rollers 59 are supported on a flange 59*b* of the fitting tool 59*a* so as to rotate on a horizontal plane. The adjusting guide rail 58 constitutes a guide groove 58*a*, and the second rollers 59 are rotatably inserted into the guide groove 58*a*.

(4)-3 Action of Unit Guide Mechanism 50

FIG. 14 to FIG. 23 are explanatory drawings that illustrate operations to draw out or store the banknote processing unit 10 and the banknote storage unit 30.

(a) Operations to Draw Out/Store Banknote Processing Unit 10

(a)-1 Operation to Draw Out Banknote Processing Unit 10

Figure 14:
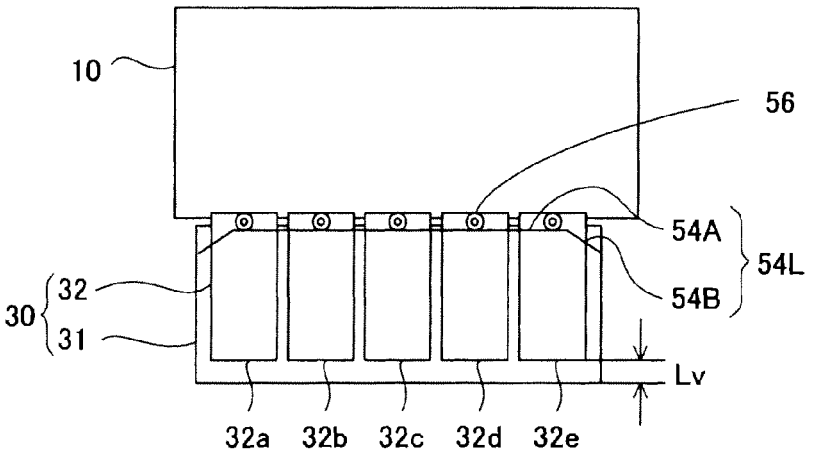
FIG. 14 is an explanatory drawing illustrating an operation of the linked guide mechanisms.

Here, it is assumed that the banknote processing unit 10 and the banknote storage unit 30 are in a storage position as shown in FIG. 14. In this storage position, the five first rollers 56 that are mounted to the banknote storage parts 32 are located in the general part 54A of the storing guide rail 54R and are positioned within the respective positioning parts 55*a* to 55*e* of the positioning mechanism 55 as shown in FIG. 10. At this time, as shown in FIG. 14, the banknote storage parts 32 are in a suspended position in which the banknote storage parts 32 are separated from the bottom of the storage body 31 by a distance Lv.

Figure 15:
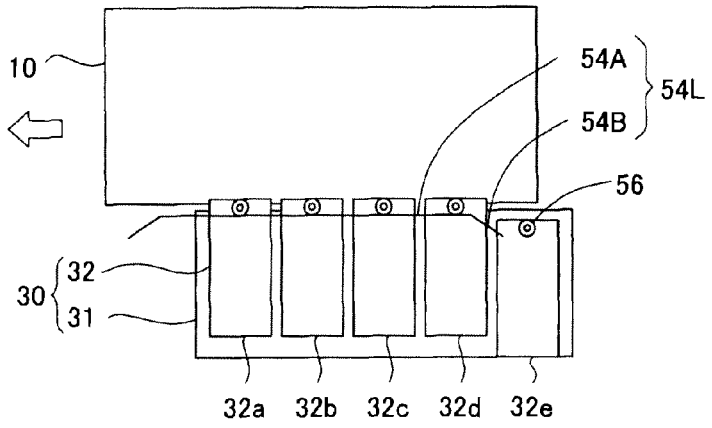
FIG. 15 is an explanatory drawing illustrating an operation that is a continuation of the operation illustrated in FIG. 14.
Figure 16:
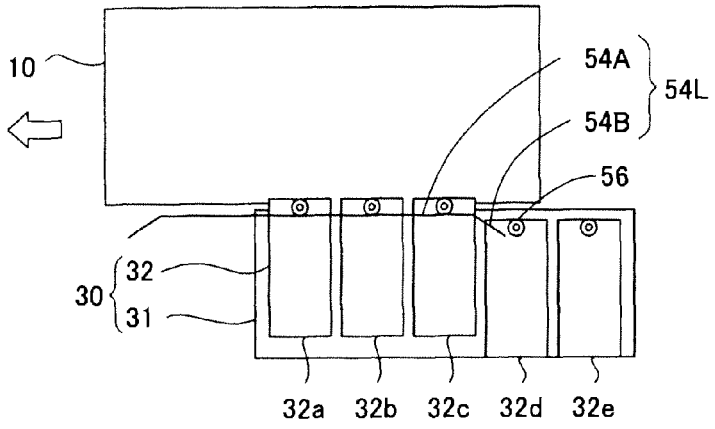
FIG. 16 is an explanatory drawing illustrating an operation that is a continuation of the operation illustrated in FIG. 15.
Figure 17:
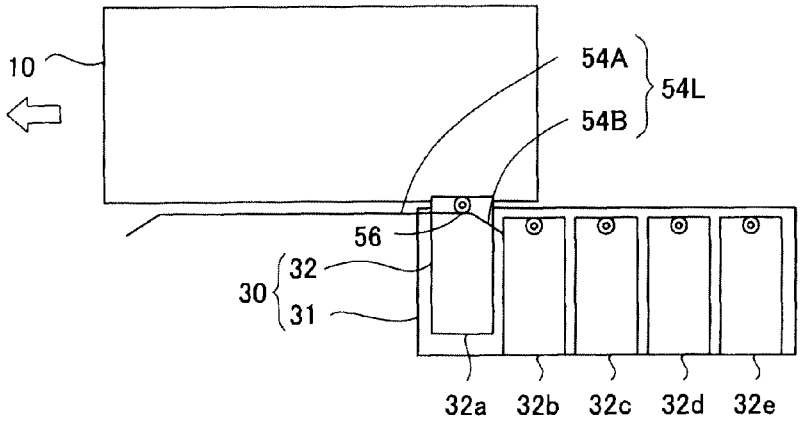
FIG. 17 is an explanatory drawing illustrating an operation that is a continuation of the operation illustrated in FIG. 16.

Further, the connection mechanism 45 shown in FIG. 4 is set to the non-connecting mode as shown in FIG. 4, and furthermore, as described later, a lock mechanism 60 (see FIG. 24) is set to a position at which the lock mechanism 60 does not lock the banknote processing unit 10. When the handle 11*a* (see FIG. 5) of the banknote processing unit 10 is manually grasped and pulled, the banknote processing unit 10 moves in the arrow direction as shown in FIG. 15. At this time, as shown in FIG. 10 and FIG. 11, among the five first rollers 56 positioned in the positioning parts 55*a* to 55*e*, three of the first rollers 56 rise along inclined faces 55*s* of the positioning parts 55*b* to 55*d* from the initial stage of the operation, and after the three first rollers 56 finish rising, the other two first rollers 56 come out from the positioning parts 55*a* and 55*e*. Hence, because the five first rollers 56 do not come out from the positioning mechanism 55 at the same time, a load (operating force) in the initial stage of the operation can be decreased.

Figure 18:
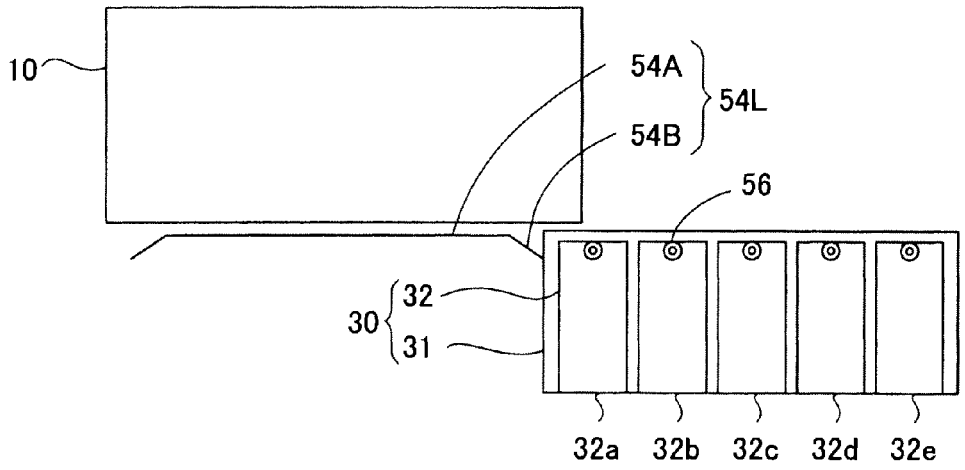
FIG. 18 is an explanatory drawing illustrating an operation that is a continuation of the operation illustrated in FIG. 17.

As shown in FIG. 15, accompanying movement of the banknote processing unit 10, the first roller 56 of the banknote storage part 32*e* is guided by the inclined guide part 54B. As a result, the banknote storage part 32*e* gradually descends and moves to a retracted position in which the banknote storage part 32*e* is mounted on the bottom face of the storage body 31. Further, when the banknote processing unit 10 moves through the states illustrated in FIG. 16 and FIG. 17, the banknote storage parts 32*d*, 32*c*, 32*b* and 32*b* are guided in sequence by the inclined guide part 54B and move to the retracted position. As a result, as shown in FIG. 18, the banknote processing unit 10 enters a drawn-out position. By drawing out the banknote processing unit 10 in this manner, jammed banknotes or the like can released as described above.

(a)-2 Operation to Store Banknote Processing Unit 10

Figure 19:
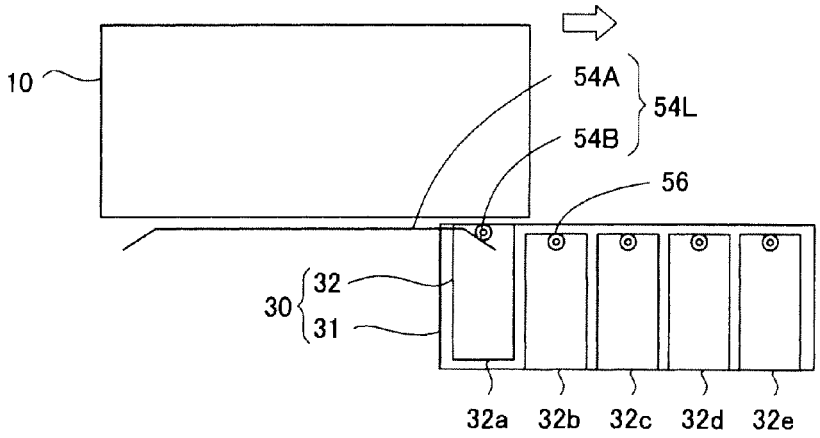
FIG. 19 is an explanatory drawing illustrating an operation that is a continuation of the operation illustrated in FIG. 18.

In order to store the banknote processing unit 10 in the housing 102, as shown in FIG. 19, a force is applied to the banknote processing unit 10 in a direction that pushes the banknote processing unit 10 into the housing 102. At this time, as shown in FIG. 13, if the position of the banknote storage part 32*a* deviates in the lateral direction, the second rollers 59 of the horizontal direction guide mechanism 57 contact against the end part of the adjusting guide rail 58 and are guided into the guide groove 58*a* of the adjusting guide rail 58. As a result, the banknote storage parts 32 are aligned in the horizontal direction.

Further, when the first rollers 56 reach the storing guide rail 54L (54R), as shown in FIG. 7, one of the first rollers 56 runs onto the supporting erect part 54Lc of the storing guide rail 54L, and another of the first rollers 56 runs onto the supporting horizontal part 54Rb of the storing guide rail 54R. Subsequently, as shown in FIG. 19, the banknote storage part 32*a* is guided by the storing guide rail 54L (54R) accompanying movement of the banknote processing unit 10 and runs onto the general part 54A from the inclined guide parts 54B. In addition, as the banknote processing unit 10 moves, the banknote storage parts 32*b* to 32*e* are lifted up in sequence by the respective first rollers 56 thereof moving from the inclined guide part 54B to the general part 54A, are set so as to face towards the transport path of the connection mechanism 45, and enter the storage position shown in FIG. 14 through the states illustrated in FIG. 17, FIG. 16 and FIG. 15. At this time, as shown in FIG. 10, the banknote storage parts 32 are positioned when the first rollers 56 reach the positioning mechanism 55. Further, as shown in FIG. 3, by placing the connection mechanism 45 in the connecting mode, the banknote handling device 1 enters a drivable state.

(b) Operations of Banknote Storage Unit 30

(b)-1 Operation to Draw Out Banknote Storage Unit 30

Figure 20:
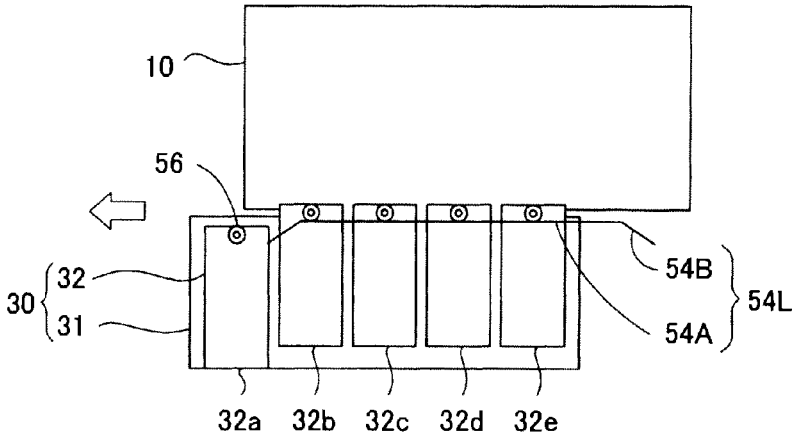
FIG. 20 is an explanatory drawing illustrating an operation that is a continuation of the operation illustrated in FIG. 19.
Figure 21:
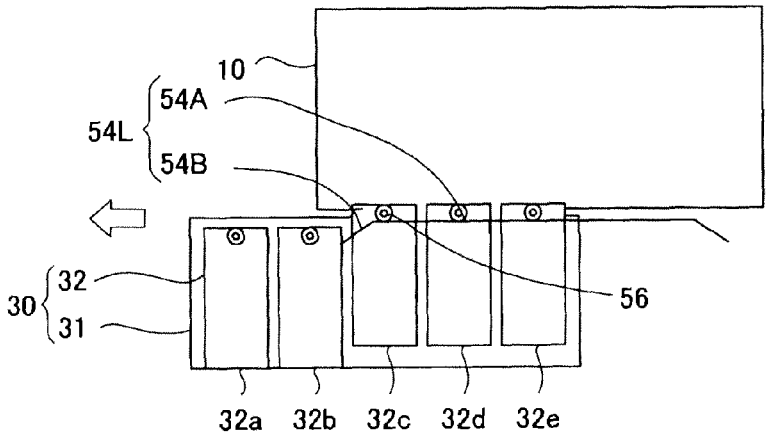
FIG. 21 is an explanatory drawing illustrating an operation that is a continuation of the operation illustrated in FIG. 20.
Figure 22:
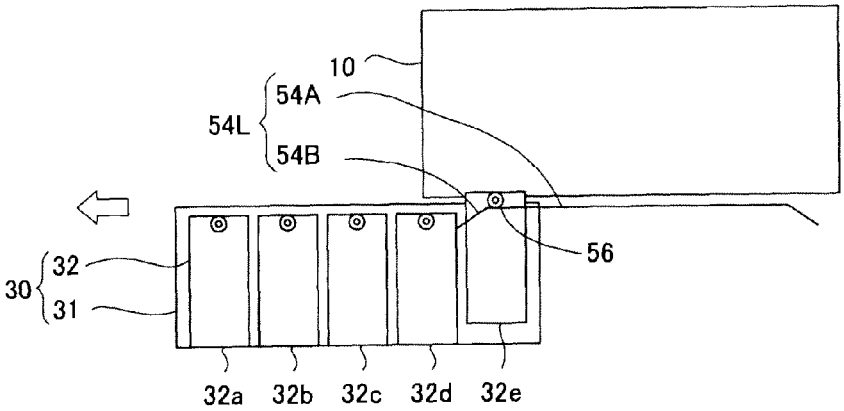
FIG. 22 is an explanatory drawing illustrating an operation that is a continuation of the operation illustrated in FIG. 21.

In order to draw out the banknote processing unit 10, similarly to the banknote storage unit 30, the connection mechanism 45 is set to the non-connecting mode and the lock mechanism 60 is set to the non-locking position. Subsequently, as shown in FIG. 20, when the user manually grasps and pulls the handle 31*a* (see FIG. 5) of the banknote storage unit 30, the banknote storage unit 30 moves in the arrow direction. At this time, as shown in FIG. 10 and FIG. 11, among the five first rollers 56 positioned in the positioning parts 55*a* to 55*e*, three of the first rollers 56 rise along the inclined face 55*s* of the positioning parts 55*b* to 55*d* from the initial stage of the operation, and after the three first rollers 56 finish rising, the other two first rollers 56 come out from the positioning parts 55*a* and 55*e*. Hence, because the five first rollers 56 do not come out from the positioning mechanism 55 at the same time, a load (operating force) in the initial stage of the operation can be decreased.

As shown in FIG. 20, when the banknote storage unit 30 is drawn out and the first rollers 56 are guided by the inclined guide part 54B, the banknote storage part 32*a* gradually descends along the inclination of the inclined guide part 54B and moves to a retracted position in which the banknote storage part 32*e* is mounted on the bottom face of the storage body 31. Further, when the banknote storage unit 30 moves through the states shown in FIG. 21, FIG. 22 and FIG. 23, the banknote storage parts 32*b*, 32*c*, 32*d* and 32*e* are guided in sequence by the inclined guide part 54B and move to the retracted position. By drawing out the banknote storage unit 30 in this manner, the respective banknote storage parts 32 can be taken out from the storage body 31 by lifting up the respective banknote storage parts 32.

(b)-2 Operation to Store Banknote Storage Unit 30

Figure 23:
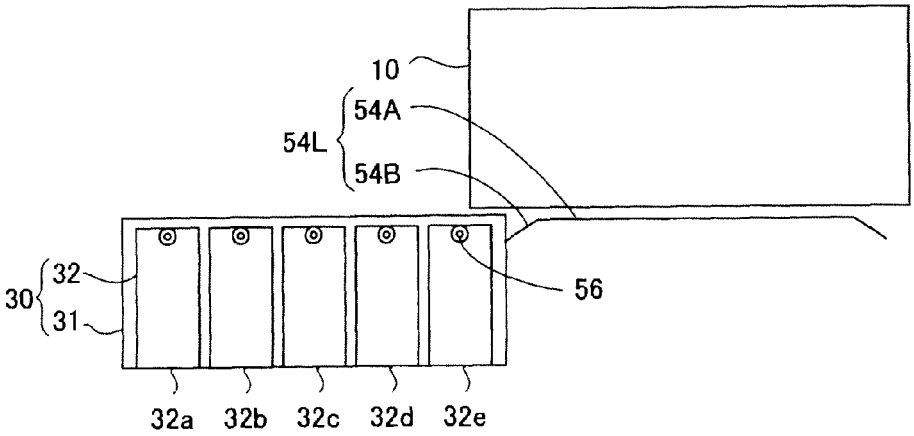
FIG. 23 is an explanatory drawing illustrating an operation that is a continuation of the operation illustrated in FIG. 22.

A force in the storing direction is applied to the banknote storage unit 30 from the state shown in FIG. 23 in order to store the banknote storage unit 30 inside the housing 102. At this time, as shown in FIG. 13, if the position of the banknote storage part 32*e* deviates in the lateral direction, the banknote storage part 32*e* is aligned in the horizontal direction by the horizontal direction guide mechanism 57. The first rollers 56 run onto the storing guide rail 54L (54R), and accompanying movement of the banknote storage unit 30, the banknote storage part 32*a* is guided by the storing guide rail 54L (54R) and runs onto the general part 54A from the inclined guide part 54B. In addition, as the banknote storage unit 30 moves, the banknote storage parts 32*d* to 32*a* are lifted up in sequence by the respective first rollers 56 thereof moving from the inclined guide part 54B to the general part 54A, and move to the connection position to thereby enter the storage position shown in FIG. 14. At this time, as shown in FIG. 10, the banknote storage parts 32 are positioned when the first rollers 56 reach the positioning mechanism 55. Further, as shown in FIG. 5, by placing the connection mechanism 45 in the connecting mode, the banknote handling device 1 enters a drivable state.

(5) Operation and Effects of Embodiment-1

The following actions and advantageous effects are obtained by the configuration of the above described embodiment.

(5)-1 As shown in FIG. 6, FIG. 9 and FIG. 14 to FIG. 17, when the banknote storage unit 30 is drawn out from the housing 102 via the first sliding mechanism 52 of the unit guide mechanism 50, the linked guide mechanisms 53 move the banknote storage parts 32 from a lifted state with respect to the storage body 31 to a retracted position in which the banknote storage parts 32 are mounted on the storage body 31. At this time, because the banknote storage parts 32 move in a direction away from the transport path of the connection mechanism 45, the respective banknote storage parts 32 can be easily taken out from the storage body 31. In addition, with regard to the linked guide mechanisms 53, the complicated configuration that is described in the conventional technology is not required in order to retract the banknote storage parts 32 from the transport path of the connection mechanism 45, and thus the configuration of the linked guide mechanisms 53 is simple.

(5)-2 As shown in FIG. 9 and FIG. 23, when moving the banknote storage parts 32 that are stored at the retracted position to the storage position together with the storage body 31, because the banknote storage parts 32 are suspended by means of the suspension mechanism 54 and move upward towards the transport path of the connection mechanism 45 (FIG. 9) along the inclined guide part 54B, the banknote storage parts 32 can connect with high precision with the connection points of the connection mechanism 45 without any mutual interference therebetween. Hence, the operational reliability of the branch connection mechanism 40 that transports banknotes from the banknote processing unit 10 to the banknote storage unit 30 can be increased.

(5)-3 Operation and effects of horizontal direction guide mechanism 57

As shown in FIG. 13, with respect to the horizontal direction guide mechanism 57 of the linked guide mechanisms 53, if the banknote storage parts 32 are misaligned in the lateral direction, the second rollers 59 contact against the end part of the adjusting guide rail 58 and are guided into the guide groove 58*a* of the adjusting guide rail 58. As a result, the banknote storage parts 32 can be reliably guided in the horizontal direction.

(5)-4 As shown in FIG. 10 and FIG. 11, because the positioning mechanism 55 of the linked guide mechanisms 53 positions the banknote storage parts 32 by letting the first rollers 56 fall into the recessed positioning parts 55*a* to 55*e*, respectively, the connection reliability can be increased. Furthermore, because lengths of the positioning parts 55*a* to 55*e* in the horizontal direction of the recesses are different and consequently the first rollers 56 do not come out from the positioning parts at the same time, a load (operating force) in the initial stage of the operation can be decreased.

(6) Lock Mechanism 60

(6)-1 Configuration of Lock Mechanism 60

Figure 24:
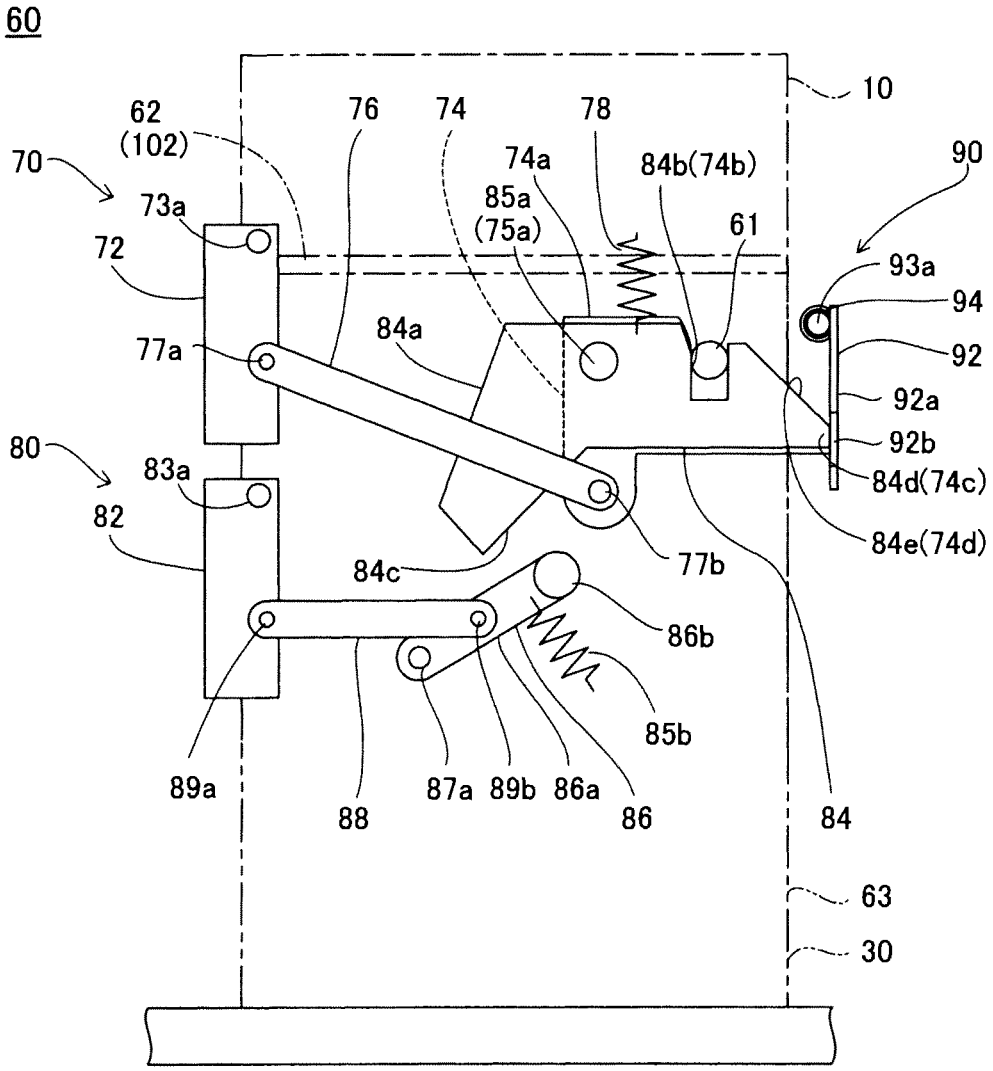
FIG. 24 is a side view that illustrates a lock mechanism.
Figure 25:
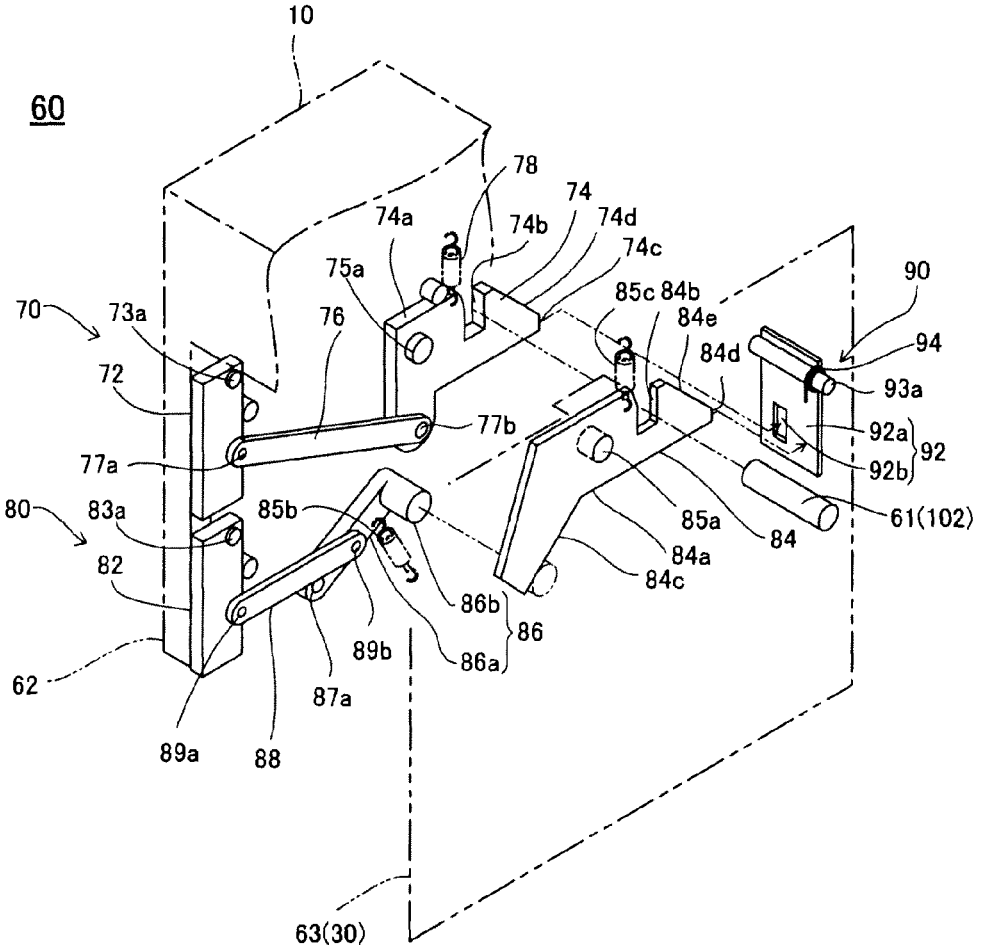
FIG. 25 is an exploded perspective view of the lock mechanism.

FIG. 24 is a side view illustrating the lock mechanism 60, and FIG. 25 is an exploded perspective view of the lock mechanism 60. The lock mechanism 60 is a mechanism for locking drawing out of the banknote processing unit 10 and the banknote storage unit 30. The lock mechanism 60 includes a lock pin 61 that is installed in a protruding manner from an inner wall of the housing 102, a first lock mechanism 70 for locking the banknote processing unit 10, a second lock mechanism 80 for locking the banknote storage unit 30, and a linked lock mechanism 90.

The first lock mechanism 70 includes a first operation part 72, a first lock member 74, a link member 76, and a spring 78. The first operation part 72 is rotatably supported around a rotary shaft 73*a* on a support substrate 62 that is extended from a lower part of the banknote processing unit 10, and is a member that a user operates to perform an operation to move the first lock member 74 from a locking position to a non-locking position. The first lock member 74 includes a lock plate body 74*a*, and is rotatably supported by a rotary shaft 75*a* on the support substrate 62, and is urged by a spring 78. The lock plate body 74*a* includes, on an upper part thereof, an engagement part 74*b* that assumes an engagement position in which the engagement part 74*b* engages with the lock pin 61 or a non-locking position in which the engagement part 74*b* is not engaged with the lock pin 61. The lock plate body 74*a* also includes a stopper part 74*c* formed at an end part thereof, and an inclined face 74*d* that is formed in a continuous manner with respect to the stopper part 74*c*. The link member 76 is connected to the first operation part 72 via a connecting shaft 77*a*, and is connected to the first lock member 74 via a connecting shaft 77*b*.

Accordingly, when an operating force is applied to the first operation part 72 in the arrow direction and the first operation part 72 rotates around the rotary shaft 73*a*, the lock pin 61 that is engaged with the engagement part 74*b* can be disengaged therefrom as a result of the first lock member 74 rotating via the link member 76 against the urging force of the spring 78 around the rotary shaft 75*a*.

The second lock mechanism 80 includes a second operation part 82, a second lock member 84, a kicker member 86, a link member 88, a spring 85*b* and a spring 85*c*. The second operation part 82 is rotatably supported around a rotary shaft 83*a* on the support substrate 62, and is a member that a user operates to perform an operation to move the second lock member 84 from a locking position to a non-locking position. The second lock member 84 includes a lock plate body 84*a*, and is rotatably supported around the rotary shaft 85*a* on the support substrate 63 on the banknote storage unit 30 side, and is urged by the spring 85*b*. The lock plate body 84*a* includes an engagement part 84*b* that assumes an engagement position in which the engagement part 84*b* engages with the lock pin 61 or a non-locking position in which the engagement part 74*b* is not engaged with the lock pin 61. The lock plate body 84*a* also includes a pressing part 84*c* that protrudes diagonally downward at an end part thereof, a stopper part 84*d* formed at the other end thereof, and an inclined face 84*e* that is formed in a continuous manner from the stopper part 84*d*. The kicker member 86 is connected to the second operation part 82 through the link member 88. The kicker member 86 includes a rod-shaped kicker main body 86*a* and a kicker part 86*b* that is formed at an end part of the kicker main body 86*a*, and is supported so as to be rotatable around a rotary shaft 87*a*. The link member 88 connects the second operation part 82 and the kicker member 86 by being rotatably connected to the connecting shaft 89*b* and also via the connecting shaft 89*a* to the second operation part 82.

Accordingly, when an operating force is applied to the second operation part 82 in the arrow direction to cause the second operation part 82 to rotate around the rotary shaft 83*a*, the kicker member 86 rotates around the rotary shaft 87*a* against the urging force of the spring 85*b* via the link member 88. Further, the kicker part 86*b* of the kicker member 86 presses the pressing part 84*c* of the second lock member 84, and as a result the second lock member 84 rotates and the lock pin 61 that is engaged with the engagement part 84*b* can be disengaged therefrom.

The linked lock mechanism 90 includes a movable plate 92 that is rotatably supported by a rotary shaft 93*a*, and a spring 94, and is urged by the spring 94. The movable plate 92 includes a contact part 92*a* and a stopper part 92*b* that is formed by a hole. Rotation of the second lock member 84 is restricted by the contact part 92*a* when the stopper part 84*d* of the second lock member 84 comes in contact therewith. The stopper part 92*b* also restricts rotation of the first lock member 74 by the stopper part 74*c* entering therein.

(6)-2 Operations of Lock Mechanism 60

(a) Operation to Draw Out Banknote Processing Unit 10

Figure 26:
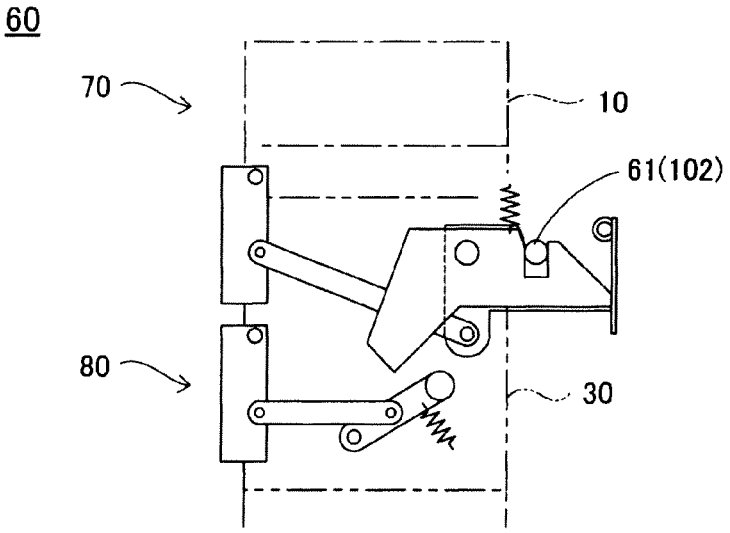
FIG. 26 is an explanatory drawing illustrating an operation of the lock mechanism.
Figure 27:
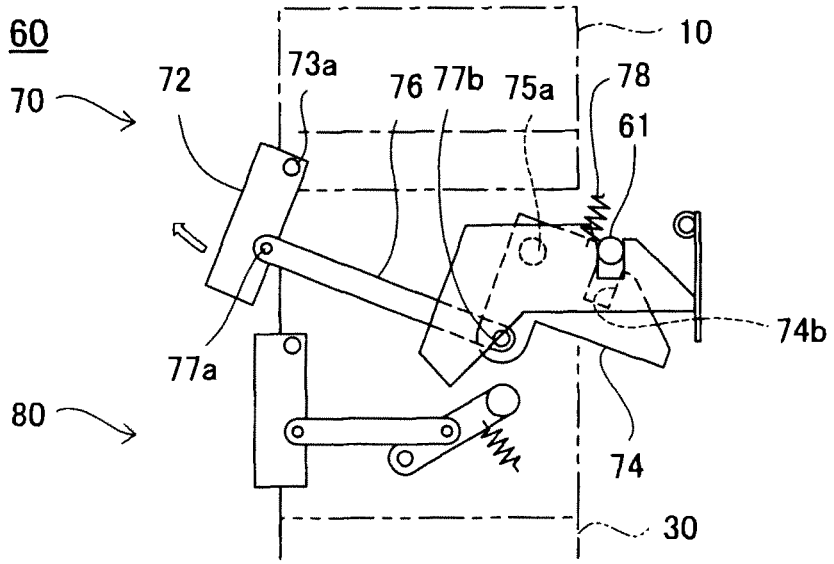
FIG. 27 is an explanatory drawing illustrating an operation that is a continuation of the operation illustrated in FIG. 26.

Here, it is assumed that the banknote processing unit 10 and the banknote storage unit 30 are in the storage position, as shown in FIG. 26. As shown in FIG. 27, when the user pulls the end part of the first operation part 72 of the first lock mechanism 70 in the arrow direction to draw out the banknote processing unit 10, the first operation part 72 rotates in the same direction around the rotary shaft 73*a*. Because one end of the link member 76 is connected through the connecting shaft 77*a* to the first operation part 72, and the other end of the link member 76 is connected to the first lock member 74 through the connecting shaft 77*b*, the first lock member 74 rotates around the rotary shaft 75*a* as a result of the rotational operation of the first operation part 72. Consequently, the engagement part 74*b* of the first lock member 74 disengages from the lock pin 61, and the first lock mechanism 70 shifts from the locking position to the non-locking position.

Figure 28:
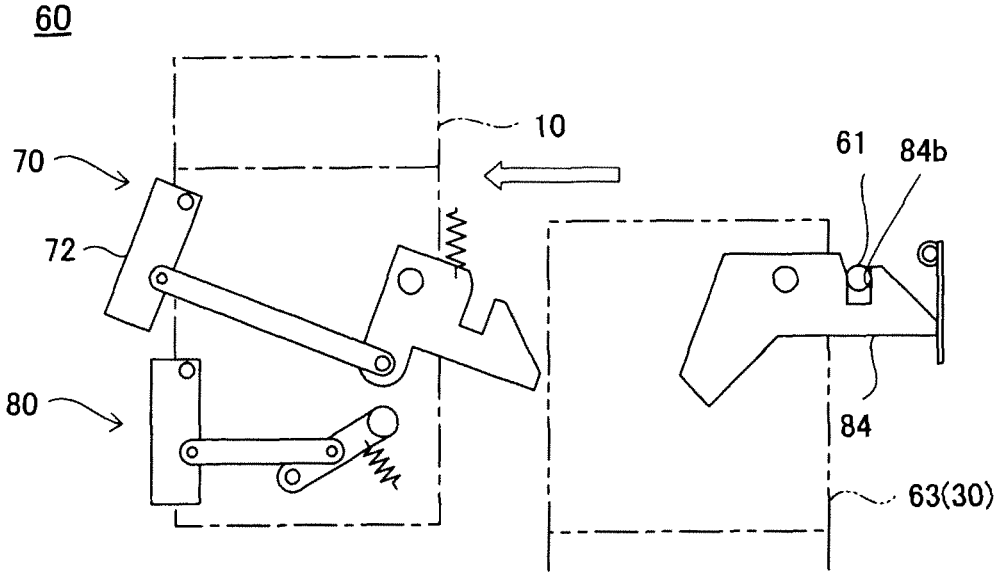
FIG. 28 is an explanatory drawing illustrating an operation that is a continuation of the operation illustrated in FIG. 27.
Figure 29:
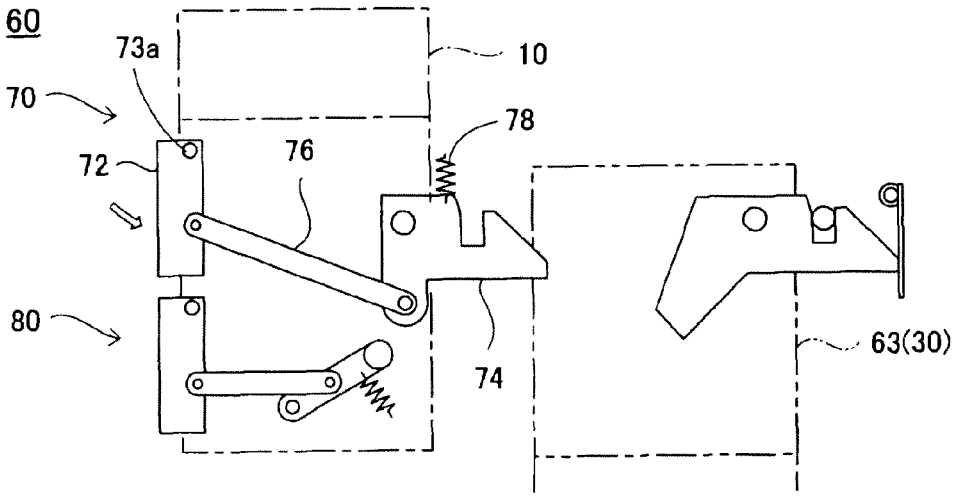
FIG. 29 is an explanatory drawing illustrating an operation that is a continuation of the operation illustrated in FIG. 28.

As shown in FIG. 28, when the banknote processing unit 10 is drawn out, some of the members of the first lock mechanism 70 and the second lock mechanism 80 that are mounted to the banknote processing unit 10 also move integrally therewith. At this time, because the second lock member 84 of the second lock mechanism 80 is fixed to the support substrate 63 on the banknote storage unit 30 side, the engagement part 84*b* maintains the locking position in which the engagement part 84*b* is engaged with the lock pin 61, and thus drawing out of the banknote storage unit 30 is restricted. Thereafter, as shown in FIG. 29, when the hand of the user is released from the first operation part 72 of the first lock mechanism 70, the first operation part 72 is rotated around the rotary shaft 73*a* by the urging force of the spring 78 and returns to the initial position thereof.

Figure 30:
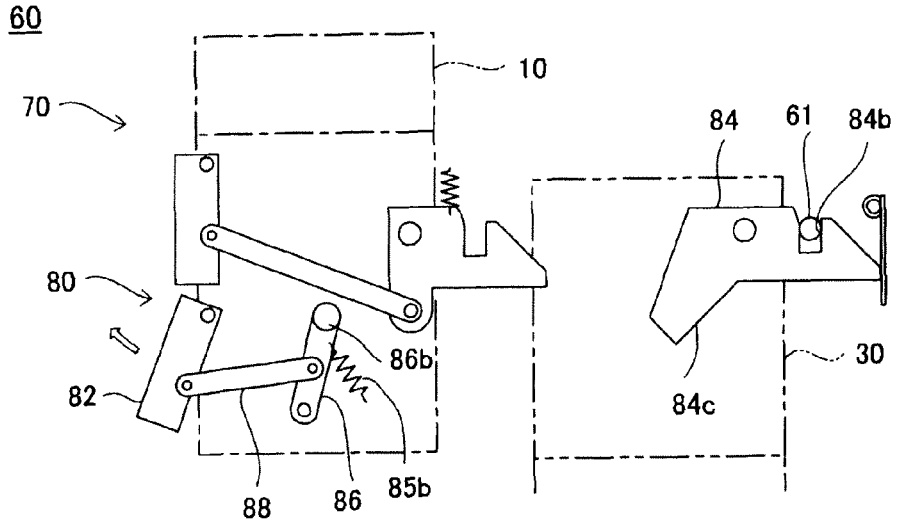
FIG. 30 is an explanatory drawing illustrating an operation that is a continuation of the operation illustrated in FIG. 29.

At this time, as shown in FIG. 30, even if the second operation part 82 of the second lock mechanism 80 is rotationally operated to cause the kicker member 86 to rotate via the link member 88, since the kicker part 86*b* does not contact against the pressing part 84*c* of the second lock member 84, the second lock member 84 does not rotate. Hence, the engagement part 84*b* does not disengage from the lock pin 61, and the banknote storage unit 30 maintains the locking position.

Figure 31:
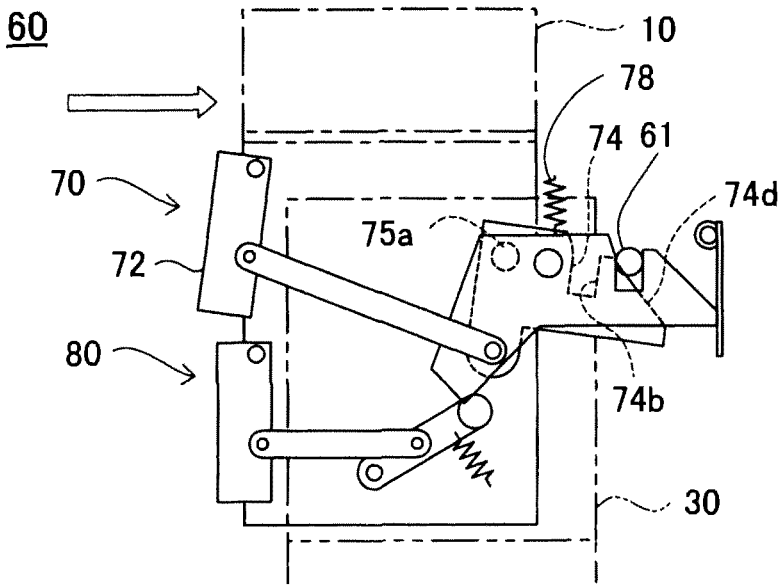
FIG. 31 is an explanatory drawing illustrating an operation that is a continuation of the operation illustrated in FIG. 30.

Next, as shown in FIG. 31, when the banknote processing unit 10 is pushed in from the drawn-out position and returns to the storage position, the first lock mechanism 70 that is integrated with the banknote processing unit 10 also moves in the same direction. Further, when the inclined face 74*d* of the first lock member 74 contacts against the lock pin 61, the first lock member 74 rotates around the rotary shaft 75*a* against the urging force of the spring 78, and the engagement part 74*b* engages with the lock pin 61. Thereafter, the first lock member 74 rotates in the opposite direction under the urging force of the spring 78. As a result, the first lock mechanism 70 shifts to the locking position and thus drawing out of the banknote processing unit 10 is restricted.

(b) Operation to Draw Out Banknote Storage Unit 30

Figure 32:
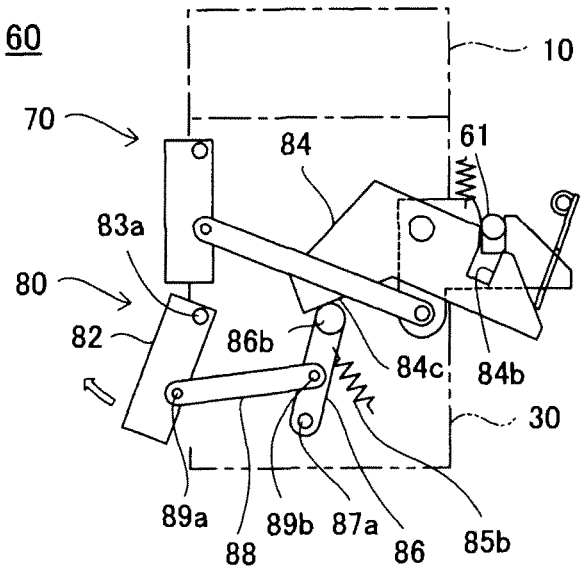
FIG. 32 is an explanatory drawing illustrating an operation that is a continuation of the operation illustrated in FIG. 31.

Here, it is assumed that the banknote processing unit 10 and the banknote storage unit 30 are in the storage position as shown in FIG. 26. In this state, when the user pulls the end part of the second operation part 82 of the second lock mechanism 80 in the arrow direction as shown in FIG. 32 to draw out the banknote processing unit 10, the second operation part 82 rotates in the same direction around the rotary shaft 83*a*. At the second operation part 82, one end part of the link member 88 is connected to the connecting shaft 89*a*, and the other end part of the link member 88 is connected to the connecting shaft 89*b*, and therefore, the rotation of the second operation part 82 causes the kicker member 86 to rotate around the rotary shaft 87*a*, via the link member 88. Further, the kicker part 86*b* of the kicker member 86 pushes the pressing part 84*c* of the second lock member 84 and the second lock member 84 rotates around the rotary shaft 87*a*. As a result, the engagement part 84*b* of the second lock member 84 disengages from the lock pin 61, and the second lock mechanism 80 shifts from the locking position to the non-locking position.

Figure 33:
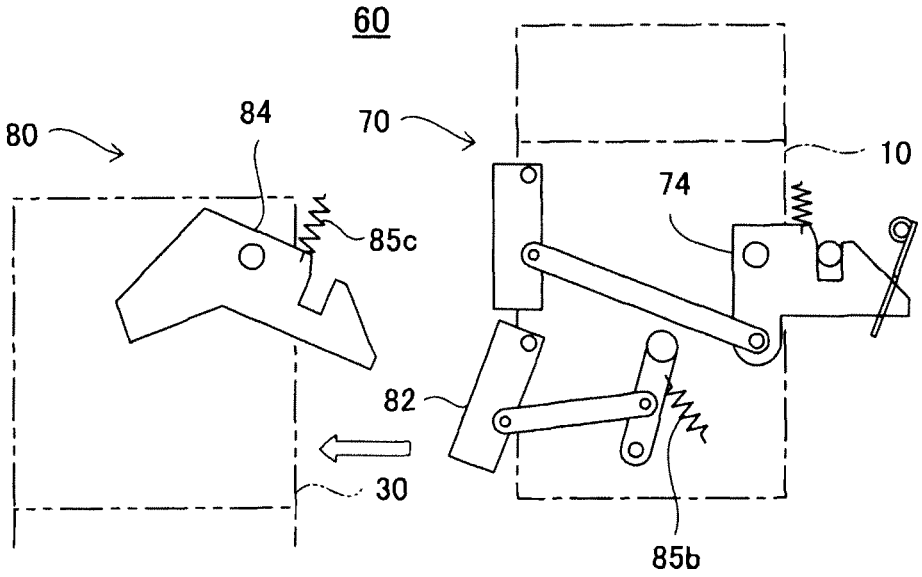
FIG. 33 is an explanatory drawing illustrating an operation that is a continuation of the operation illustrated in FIG. 32.
Figure 34:
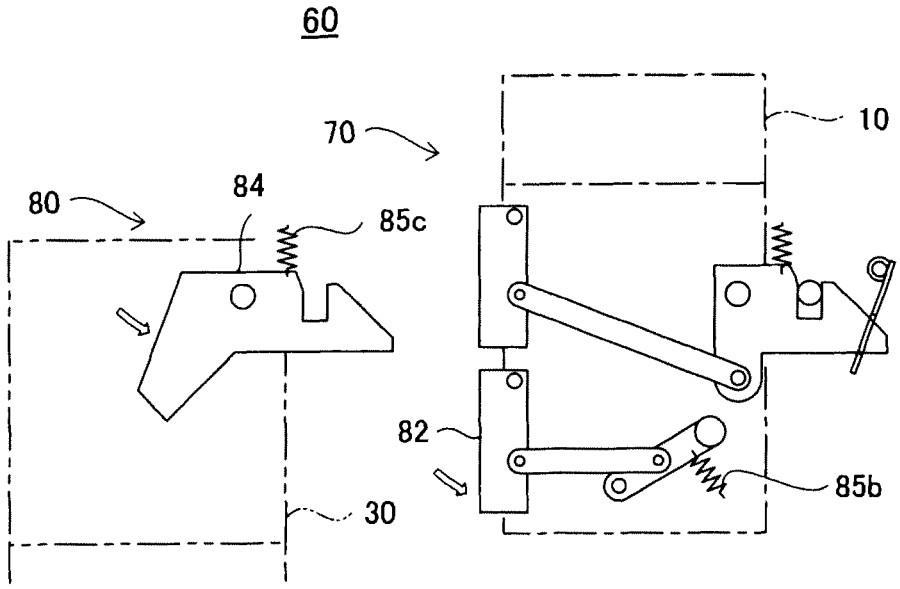
FIG. 34 is an explanatory drawing illustrating an operation that is a continuation of the operation illustrated in FIG. 33.

As shown in FIG. 33, when the banknote storage unit 30 is drawn out, the second lock member 84 of the second lock mechanism 80 and the like that are mounted to the banknote storage unit 30 also move integrally therewith. At such time, components such as the first lock member 74 that is integrated with the banknote processing unit 10 remain at the storage position. Further, as shown in FIG. 34, the second lock member 84 of the second lock mechanism 80 returns to its original position under the spring force of the spring 85*c*, and the second operation part 82 returns to its original position under the force of the spring 85*b*.

Figure 35:
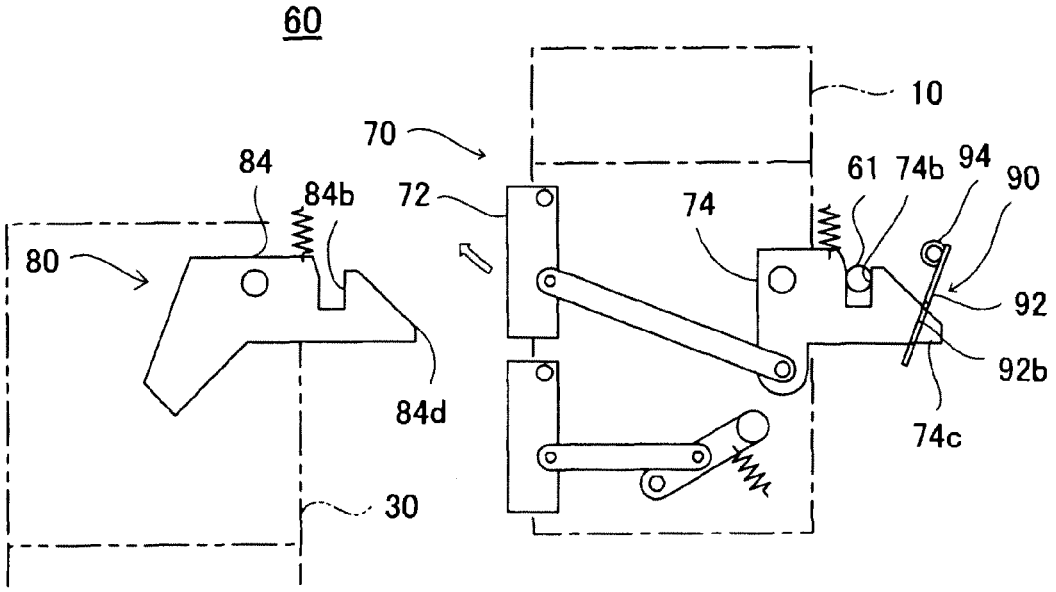
FIG. 35 is an explanatory drawing illustrating an operation that is a continuation of the operation illustrated in FIG. 34.

As shown in FIG. 35, because the second lock member 84 moves, the movable plate 92 of the linked lock mechanism 90 rotates under the spring force of the spring 94 from a state in which rotation thereof had been restricted by contact thereof against the stopper part 84*d* of the second lock member 84. As a result, the stopper part 92*b* of the movable plate 92 enters the stopper part 84*d* of the second lock member 84, and rotation of the second lock member 84 is restricted. Hence, in the second lock member 84, the engagement part 84*b* is engaged with the lock pin 61. In this state, even if the first operation part 72 is rotated, because the stopper part 74*c* interferes with the stopper part 92*b* of the movable plate 92, rotation of the first lock member 74 is restricted and the first lock mechanism 70 maintains the locking position. Further, if the banknote storage unit 30 is returned to the storage position, the second lock member 84 returns to the locking position in which the second lock member 84 is engaged with the lock pin 61.

(7) Operation and Effects of Embodiment-2

(7)-1 In a case where the banknote processing unit 10 and the banknote storage unit 30 are both in the storage position, the lock mechanism 60 functions so that only one of the banknote processing unit 10 and the banknote storage unit 30 can be drawn out from the housing 102. That is, as shown in FIG. 30, when the banknote processing unit 10 is drawn out from the housing 102, even if the second operation part 82 of the second lock mechanism 80 is rotationally operated, the kicker part 86*b* of the kicker member 86 does not contact against the pressing part 84*c* of the second lock member 84, and the second lock member 84 can not be rotated, and hence the second lock mechanism 80 maintains the locking position. On the other hand, as shown in FIG. 35, when the banknote storage unit 30 is drawn out from the housing 102, because the stopper part 92*b* of the movable plate 92 of the linked lock mechanism 90 is engaged with the stopper part 84*d* of the second lock member 84 and rotation of the first lock member 74 is restricted, even if the first operation part 72 of the first lock mechanism 70 is rotationally operated, the first lock member 74 can not be rotated, and thus the first lock mechanism 70 maintains the locking position.

The following advantageous effects are obtained by configuring the lock mechanism 60 in this manner so that the banknote processing unit 10 and the banknote storage unit 30 can not be moved to a drawn-out position at the same time. In a case where the banknote processing unit 10 and the banknote storage unit 30 are configured so as to move on a rail that is arranged in the horizontal direction, for example, when the banknote processing unit 10 is placed in a drawn-out position, a situation is liable to occur in which the banknote processing unit 10 inclines and a clearance between the banknote processing unit 10 and the banknote storage unit 30 narrows. To ensure that the banknote storage unit 30 can be drawn out smoothly even in this state, a large clearance is required between the banknote processing unit 10 and the banknote storage unit 30 to ensure that the banknote processing unit 10 does not interfere with the banknote storage unit 30. When there is large clearance therebetween, a large moving distance is required in order to move the banknote storage unit 30 to the connection points of the connection mechanism 45, and the connection configuration also becomes complicated. However, according to the above described embodiment, because the lock mechanism 60 allows only either one of the banknote processing unit 10 and the banknote storage unit 30 to be drawn out, it is not necessary to provide a large clearance therebetween, and the configuration for connecting with the connection mechanism 45 is simplified and smooth drawing out operations can be ensured.

(7)-2 The first and second engagement member to be locked are common between the first and second lock mechanisms, and thus the configuration can be simplified.

Note that the present invention is not limited to the above described embodiment, and the invention can be implemented in various forms within a range that does not deviate from the spirit and scope thereof. For example, the following modification is also possible. The present invention can be applied to a device that handles various kinds of paper sheets, such as banknotes, cards and paper (printed paper).

REFERENCE SIGNS LIST

10 . . . Banknote processing unit
11*a* . . . Handle
12 . . . Bottom cover
20 . . . Banknote receiving/dispensing port part
22 . . . Banknote identifying part
23 . . . Temporary storage part
26 . . . Upper unit transport mechanism
26*a* . . . Transport path for deposits
26*b* . . . Transport path for withdrawals
26*c* . . . Transport path for identification
26*d* . . . Temporary storage part transport path
27 . . . Connecting transport mechanism
28 . . . Main transport path
28*a* . . . Sub-transport path
28*a* . . . Sub-transport path
28*b* . . . Sub-transport path
30 . . . Banknote storage unit
31 . . . Storage body
31*a* . . . Handle
32 . . . Banknote storage part
32*a*, 32*b*, 32*c*, 32*d*, 32*e* . . . Banknote storage part
40 . . . Branch connection mechanism
41 . . . Gate
42 . . . Roller group
45 . . . Connection mechanism
46 . . . Upstream guide part
46*a* . . . Guide main body
46*b*, 48*b* . . . Guide groove
47*a* . . . Rotary shaft
47*b* . . . Motor drive shaft
48 . . . Downstream guide part
48*a* . . . Guide main body
50 . . . Unit guide mechanism
51 . . . Second sliding mechanism
51*a* . . . Guide part
51*b* . . . Guided part
52 . . . First sliding mechanism
52*a* . . . Guide part
52*b* . . . Guided part
53 . . . Linked guide mechanisms
54 . . . Suspension mechanism
54R, 54L . . . Storing guide rail
54A . . . General part
54B . . . Inclined guide part
54La . . . Rail base
54Lb . . . Horizontal part
54Lc . . . Supporting erect part
54Ra . . . Rail base
54Rb . . . Supporting horizontal part
55 . . . Positioning mechanism
55*a*, 55*b*, 55*c*, 55*d*, 55*e* . . . Positioning part
55*s* . . . Inclined face
56 . . . First roller
56*a* . . . Inclined groove
57 . . . Horizontal direction guide mechanism
58 . . . Adjusting guide rail
58*a* . . . Guide groove
59 . . . Second roller
59*a* . . . Fitting tool
59*b* . . . Flange
60 . . . Lock mechanism
61 . . . Lock pin

62 . . . Support substrate
63 . . . Support substrate
70 . . . First lock mechanism
72 . . . First operation part
73*a* . . . Rotary shaft
74 . . . First lock member
74*a* . . . Lock plate body
74*b* . . . Engagement part
74*c* . . . Stopper part
74*d* . . . Inclined face
75*a* . . . Rotary shaft
76 . . . Link member
77*a* . . . Connecting shaft
77*b* . . . Connecting shaft
78 . . . Spring
80 . . . Second lock mechanism
82 . . . Second operation part
83*a* . . . Rotary shaft
84 . . . Second lock member
84*a* . . . Lock plate body
84*b* . . . Engagement part
84*c* . . . Pressing part
84*d* . . . Stopper part
84*e* . . . Inclined face
85*a* . . . Rotary shaft
85*b* . . . Spring
85*c* . . . Spring
86 . . . Kicker member
86*a* . . . Kicker main body
86*b* . . . Kicker part
87*a* . . . Rotary shaft
88 . . . Link member
89*a* . . . Connecting shaft
89*b* . . . Connecting shaft
90 . . . Linked lock mechanism
92 . . . Movable plate
92*a* . . . Contact part
92*b* . . . Stopper part
93 . . . Spring
93*a* . . . Rotary shaft
94 . . . Spring
101 . . . Automatic cash transaction device
102 . . . Housing
104 . . . Housing main body
106 . . . Door
110 . . . Advice slip processing mechanism
120 . . . Customer operation part
130 . . . Coin processing device

The invention claimed is:

1. A paper sheet processing device, comprising:

a paper sheet processing unit configured to discriminate paper sheets that are inserted or dispensed;

a paper sheet storage unit having a plurality of paper sheet storage parts configured to separate and store the discriminated paper sheets;

a transport mechanism is configured to transport the paper sheets bidirectionally between the paper sheet processing unit and the paper sheet storage unit via a connection mechanism comprising a transport path that connects the paper sheet processing unit and the paper sheet storage unit;

a housing having a storage space that stores the paper sheet processing unit, the paper sheet storage unit and the transport mechanism; and a unit guide mechanism that guides in order to draw out the paper sheet storage unit from the storage space and to store the paper sheet storage unit in the storage space, wherein the paper sheet storage unit has a storage body that stores the plurality of paper sheet storage parts, and the storage body is configured so that the paper sheet storage parts assume a retracted position in which the paper sheet storage parts are placed on the storage body and so that each of the paper sheet storage parts can also be moved upward in sequence from the retracted position and stored; and the unit guide mechanism comprises a first sliding mechanism that is arranged on the housing and the storage body, and that guides in a horizontal direction in order to draw out the paper sheet storage unit from the storage space and also to store the paper sheet storage unit in the storage space; and linked guide mechanisms having a storing guide part that is arranged in the horizontal direction inside the housing, and a guided part that is arranged on the paper sheet storage part and is guided by the storing guide part, wherein the storing guide part is configured so that, when guiding the guided part at a time of storing the paper sheet storage unit in the storage space, the storing guide part lifts up each of the paper sheet storage parts in sequence from the retracted position and sets the paper sheet storage parts on the transport path of the connection mechanism.

2. The paper sheet processing device according to claim 1, wherein the storing guide part is storing guide rails that are arranged on both sides of the paper sheet storage parts that are stored in the storage space; and the guided part is first rollers that roll along the storing guide rails.

3. The paper sheet processing device according to claim 2, wherein the storing guide rails comprise a general part that is arranged in the horizontal direction and an inclined guide part that inclines downward from an end part of the general part, and are configured so that, by the first rollers rolling along the inclined guide part, the paper sheet storage parts are guided between the retracted position and a position at which the paper sheet storage parts are set on the transport path.

4. The paper sheet processing device according to claim 3, wherein the storing guide rails comprise a positioning mechanism having a positioning part that positions the first rollers when the paper sheet storage parts are set on the transport path.

5. The paper sheet processing device according to claim 4, wherein positions at which the first rollers separate from the plurality of positioning parts are formed to be respectively different in the horizontal direction.

6. The paper sheet processing device according to claim 3, wherein the linked guide mechanisms comprise a horizontal direction guide mechanism that guides the paper sheet storage parts in a direction that intersects with a storing direction.

7. The paper sheet processing device according to claim 6, wherein the horizontal direction guide mechanism comprises an adjusting guide rail that is arranged along the storing guide part, and second rollers that are mounted on the paper sheet storage parts, wherein the second rollers are configured to receive a force from the adjusting guide rail and guide the paper sheet storage parts in the horizontal direction.

8. The paper sheet processing device according to claim 1, wherein the unit guide mechanism comprises a second sliding mechanism that guides the paper sheet processing unit in order to draw out the paper sheet processing unit from the storage space or store the paper sheet processing unit in the storage space; and in the linked guide mechanisms, the storing guide part is mounted to the paper sheet processing unit.

9. The paper sheet processing device according to claim 8, further comprising a lock mechanism having a first lock mechanism that locks drawing out of the paper sheet processing unit and a second lock mechanism that locks drawing out of the paper sheet storage unit; wherein the first lock mechanism comprises a first engagement member to be locked that is provided in the housing, a first operation part, and a first lock member that moves in response to movement of the first operation part to assume a locking position at which the first lock member engages with the first engagement member to be locked or a non-locking position at which the first lock member does not engage therewith;

the second lock mechanism comprises a second engagement member to be locked that is provided in the housing, a second operation part, and a second lock member that moves in response to movement of the second operation part to assume a locking position at which the second lock member engages with the second engagement member to be locked or a non-locking position at which the second lock member does not engage therewith, wherein the first and second lock mechanisms are linked so as to restrict shifting of the second lock member to the non-locking position when the paper sheet processing unit is in a drawn-out position, and to restrict shifting of the first lock member to the non-locking position when the paper sheet storage unit is in a drawn-out position.

10. The paper sheet processing device according to claim 9, wherein the first and second engagement members to be locked are single members with which the first and second lock members engage, respectively.

11. The paper sheet processing device according to claim 1, wherein the storing guide part is configured to, when the paper sheet storage parts is set on the transport path of the connection mechanism, lift up each of the paper sheet storage parts sequentially from the retracted position to the storage space separated from the retracted position by a predetermined distance.

* * * * *